US012514289B2

(12) United States Patent
Romming et al.

(10) Patent No.: US 12,514,289 B2
(45) Date of Patent: Jan. 6, 2026

(54) CARTRIDGE HAVING PRESSURE EQUALIZATION

(71) Applicant: Körber Technologies GmbH, Hamburg (DE)

(72) Inventors: Niklas Romming, Plön (DE); Lennart Kock, Hamburg (DE); Arne Rosenbohm, Steinkirchen (DE); Christof Schuster, Hamburg (DE); Max Bergmann, Hamburg (DE)

(73) Assignee: KÖRBER TECHNOLOGIES GmbH, Hamburg (DE)

( * ) Notice: Subject to any disclaimer, the term of this patent is extended or adjusted under 35 U.S.C. 154(b) by 468 days.

(21) Appl. No.: 17/910,627

(22) PCT Filed: Mar. 3, 2021

(86) PCT No.: PCT/EP2021/055371
§ 371 (c)(1),
(2) Date: Sep. 9, 2022

(87) PCT Pub. No.: WO2021/185584
PCT Pub. Date: Sep. 23, 2021

(65) Prior Publication Data

US 2023/0133206 A1 May 4, 2023

(30) Foreign Application Priority Data

Mar. 16, 2020 (DE) ..... 102020107124.8

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/485* (2020.01); *A24F 40/10* (2020.01)

(58) Field of Classification Search
CPC ..... A24F 40/10; A24F 40/42; A24F 40/485
See application file for complete search history.

(56) References Cited

U.S. PATENT DOCUMENTS

2016/0332754 A1 11/2016 Brown et al.
2017/0071255 A1 3/2017 Revell
(Continued)

FOREIGN PATENT DOCUMENTS

CA 3070106 A1 1/2019
DE 102017123866 A1 4/2019
(Continued)

OTHER PUBLICATIONS

Li FR3071705A1| English Machine Translation (Year: 2019).*

*Primary Examiner* — Michael H. Wilson
*Assistant Examiner* — Daniel Edward Vakili
(74) *Attorney, Agent, or Firm* — Dinsmore & Shohl LLP

(57) ABSTRACT

A cartridge for an electronic cigarette or a portable inhaler has a rigid reservoir for receiving a liquid. The reservoir has at least one extraction opening which is configured to enable the extraction of liquid from the reservoir. The reservoir has one or more pressure regulation elements in an interior of the reservoir which are arranged in a wall of the reservoir and through which no exit of liquid from the reservoir is possible. The pressure regulation elements are selected independently of one another from the list comprising non-return valves, gas-permeable but liquid-impermeable diaphragms, and deformable wall portions.

19 Claims, 12 Drawing Sheets

(56) References Cited

U.S. PATENT DOCUMENTS

| | | | | |
|---|---|---|---|---|
| 2017/0172212 | A1* | 6/2017 | Phillips | H05B 1/0244 |
| 2017/0233114 | A1 | 8/2017 | Christensen et al. | |
| 2017/0360093 | A1 | 12/2017 | Fernando | |
| 2018/0035717 | A1* | 2/2018 | Batista | B65D 35/38 |
| 2018/0154092 | A1* | 6/2018 | Patoret | A24F 40/42 |
| 2018/0184722 | A1* | 7/2018 | Murison | A61M 15/06 |
| 2018/0343921 | A1 | 12/2018 | Daryani | |
| 2019/0373957 | A1 | 12/2019 | Bright et al. | |
| 2020/0000151 | A1* | 1/2020 | Fraser | B01D 53/0407 |
| 2021/0195951 | A1 | 7/2021 | Niebuhr et al. | |

FOREIGN PATENT DOCUMENTS

| | | | | |
|---|---|---|---|---|
| FR | 3071705 | A1 * | 4/2019 | A24F 40/485 |
| WO | WO-2019145710 | A1 * | 8/2019 | A24F 40/42 |

* cited by examiner

CARTRIDGE HAVING PRESSURE EQUALIZATION

CROSS-REFERENCE TO RELATED APPLICATIONS

This application is the U.S. National Stage of PCT/EP2021/055371 filed on Mar. 3, 2021, which claims priority to German Patent Application 102020107124.8 filed on Mar. 16, 2020, the entire content of both are incorporated herein by reference in their entirety.

FIELD OF THE INVENTION

The invention relates to a cartridge for an electronic cigarette or a portable inhaler, a vaporizer unit comprising a corresponding cartridge as well as a vaporizer system comprising a corresponding cartridge or a corresponding vaporizer unit.

BACKGROUND OF THE INVENTION

It is known that the administration of active ingredients via the airways is an efficient and gentle method of supplying physiologically active substances to the human or animal body, wherein in particular traditional inhalation processes which can be performed with sometimes the simplest of means are firmly established both in conventional medicine and in the field of household remedies. In these simple processes, an active ingredient dissolved in a carrier substance, often water, is conventionally heated in a pot or comparable vessel and thereby caused to vaporize.

Due to the increasingly critical view of smoking in many parts of the world, i.e. the consumption of tobacco products by the burning thereof and inhalation of the resultant smoke, for example, in the form of cigarettes or cigars, there has been increased interest in such inhalation methods in recent years, in the case of which the physiologically active substances which are traditionally absorbed via tobacco smoke are instead applied via corresponding inhalation processes which do not require the burning of tobacco, wherein this concept is also applied to other active ingredients which are otherwise often associated with smoking, such as, for example, tetrahydrocannabinol (THC) and other cannabinoids.

Progressive technical development has made it possible to design corresponding vaporizer systems for vaporizing a composition which contains active ingredient to be ever smaller so that now vaporizer systems are available with which vaporization of a composition which contains active ingredient can be performed in a portable handheld device which can be, for example, the size of a traditional cigar or a cigarette packet. The most prominent applications for corresponding vaporizer systems are electronic cigarettes and inhalers for medical applications.

The currently known systems are usually based on the fact that a composition stored in a reservoir which is often referred to as a liquid is vaporized by the more or less controlled supply of a thermal energy from a heating element, e.g. a spiral-wound filament, so that the user can inhale the resultant vapours.

It is necessary for this purpose that the liquid provided for the vaporization can be stored safely in the reservoir and over as long a period of time as possible. The use of closed cartridges is known from the prior art for this purpose. For practical handling, these cartridges usually have a rigid reservoir for receiving the liquid, which reservoir is closed off in the vaporizer unit by a heating unit with a wick material at least to such an extent that the liquid cannot exit from the reservoir past the wick material without an external action. These reservoirs thus make available in practice a predefined, closed volume for storing the liquid. In addition to the liquid, this volume usually comprises, after filling and closing, a gas bubble, the volume of which increases in the course of the increasing vaporization of the liquid.

Both the liquid and the gas in the reservoir undergo a change in volume or pressure with changing ambient conditions, in particular pressure and temperature. In the range of pressures between 70 kPa and 108 kPa and temperatures between −20° C. and +60° C. which is usually relevant in practice, the liquid can be assumed to be approximately uncompressible, but is subject to a temperature-dependent volume expansion of up to approx. 5%.

The properties of the gas contained in the reservoir, usually air in a mixture with small quantities of the vapour above the liquid, can be approximated via the ideal gas law, wherein pure air is assumed for the sake of simplicity:

$$pV=mR_{S,L}T.$$

Wherein p is the pressure in the reservoir, V is the gas volume in the reservoir, m is the mass of the gas in the reservoir, $R_{S,L}$ is the specific gas constant of air ($R_{S,L}$=287 J/(kg*K)) and T is the temperature of the gas contained. Between the extreme cases of the ambient conditions between 70 kPa pressure at 60° C. (e.g. at the head of a train or in an aeroplane with long-lasting direct sunshine on the cartridge) and 108 kPa pressure at −20° C. (e.g. in a cold high-pressure range) which are realistically to be assumed in practice for electronic cigarettes and medical inhalers, a predefined air quantity would change its volume in a manner free from changes in pressure by approximately a factor of 2.

In a closed off, rigid reservoir, i.e. in a constant volume, the change between these extreme cases can lead, for example, to a change in pressure of approximately 30 kPa. Even in the case of less extreme situations, significant pressure differences between the interior of the cartridge and the ambient pressure can arise as a result of a change in pressure and/or temperature in comparison with the conditions which prevail at the time of filling.

Since it must at least be possible that liquid can travel from the reservoir to the heating unit so that it vaporizes at this point and can be transformed into aerosol which reaches the user, there is only one possibility for pressure regulation in the otherwise closed off, rigid reservoir, which lies in pushing liquid via the corresponding supply, usually a wick material, in the direction of the heating unit, or suck liquid from the wick material back into the reservoir, i.e. away from the heating unit. These two cases are disadvantageous since a uniform supply of liquid to the heating unit represents a central demand on vaporizer systems which is supposed to ensure a consistent vapour experience and/or a controlled and consistent supply of medical active ingredients.

A vacuum pressure which develops in the reservoir can, for example, impair the supply of liquid and even prevent it in the worst case such that too little or even no aerosol is generated (so-called "dry puff"). Since each vaporization process further reduces the amount of liquid in the reservoir, it can arise as a result of this that no liquid is vaporized any more despite the fact that sufficient liquid is still present in the reservoir.

An unintentional pushing out of the liquid in the direction of the heating unit can in contrast lead to too much aerosol being generated or the aerosol unintentionally carrying along large quantities of unvaporized liquid. In the case of conventional wick-coil systems, the transition between the reservoir and the heating unit can usually be produced by squeezing of the wick material. Since the wick material is usually capillary and rough on the surface, the seal in this region is often unable to withstand such large pressure differences as can occur. Modern assemblies which use, for example, a plate-shaped heater chip as an electric heating element which is crossed by a plurality of microchannels and is arranged jointly with the wick material and suitable seal elements on the extraction opening only provide a limited amount of resistance to running out in the case of overpressure in the reservoir in question as a result of the surface tension of the liquid acting in the microchannels of the heater chip.

For this reason, the use of closed cartridges with rigid, closed reservoirs in vaporizer units often leads to an impairment of the vaporizer properties.

No entirely satisfactory solutions are hitherto available in the prior art in order to solve this problem. In many systems, above all in lower cost ones, the disadvantages are usually accepted because a suboptimal vapour experience and a running dry of the heating element prior to complete emptying of the reservoir are compensated for by the price. In the case of such systems from the prior art which deal with the problem, only a comparatively simple solution has hitherto been used. Conventional cartridges are deliberately embodied to be permeable so that, apart from the actual extraction openings, there are nominal breaches and/or permeable sections through which liquid can exit in the event of a threshold value of the overpressure being exceeded in the interior of the reservoir. This leakage from the reservoir is, however, undesirable precisely in the case of high-quality products, wherein some cartridge concepts from the prior art thus also provide additional intermediate chambers for collecting the escaped liquid which, however, do not solve the problem at the source, but rather only deal with the symptoms.

An alternative solution provides that the reservoir is not to be configured as rigid overall, but rather entirely as a type of bag which is composed of a flexible material and is reversibly deformable in order to compensate for the pressure fluctuations which occur in the interior of the bag. Corresponding configurations do indeed solve the pressure problem, but are often felt to be disadvantageous for various reasons. In contrast to rigid reservoirs, these bags are often more difficult to install in typical vaporizer systems and usually require a surrounding rigid carrier structure, as a result of which the number of components required and the manufacturing outlay increase. Corresponding, reversibly deformable bags are furthermore usually fragile and susceptible to damage, for example, in the case of contact with items or as a result of the action by the user. There has not least in some cases been lower end customer acceptance for corresponding bag systems, wherein in particular the visual appearance and the feel of the bag reservoir were felt to be disadvantageous.

SUMMARY OF THE INVENTION

The superordinate object of the invention was a cartridge for an electronic cigarette or a portable inhaler which overcomes or at least reduces the disadvantages of the prior art described above.

The primary object of the present invention was to indicate a cartridge with a rigid reservoir which can be used in an electronic cigarette or a portable inhaler and which enables a uniform supply of liquid to the heating unit and thus consistent vaporization properties over and beyond a wide range of ambient conditions, in particular in the case of particularly high or low temperatures and/or high or low pressures. The solution to be indicated in this regard should not impair the supply of liquid to the heating unit itself. An additional object lay in indicating a cartridge which in this case reliably prevents an undesired leak of liquid from the reservoir. One framework condition here was that the reservoir of the cartridge should be formed to be substantially rigid to ensure good processability. It was furthermore a further object to indicate a cartridge which is relatively easy to produce in terms of manufacturing technology and which makes it possible to store a liquid composition contained therein for as long and as reliably as possible. In this context, a supplementary object of the invention was to indicate an aeration and ventilation concept for cartridges.

A secondary object of the invention was to indicate a vaporizer unit comprising a corresponding cartridge and a corresponding vaporizer system.

The inventors have selected the premise that the basic requirement for a leak-free cartridge must be a substantially rigid reservoir which is closed off in a fully liquid-impervious manner apart from the extraction opening for receiving a liquid, out of which liquid cannot escape even in the case of higher pressures at any point outside the extraction opening (i.e. in the direction of a heating unit present in a vaporizer unit). It can be assumed in this case from experience that the cartridge, during operation, is covered by a heating unit which comprises a wick material and an electric heating element and is configured so that it prevents an exit of liquid through the extraction opening at least in the case of very small vacuum pressures in the interior of the reservoir.

The inventors recognised that, under these conditions, one or more elements for pressure regulation have to be provided in the interior of the reservoir in order to achieve the object, which elements are arranged in the wall of the reservoir and through which no exit of liquid from the reservoir is possible, wherein the inventors identified three possible elements for pressure regulation which solve the object already per se entirely or at least partially. These involve non-return valves, gas-permeable but liquid-impermeable diaphragms and deformable wall portions.

It was particularly surprising that the inventors discovered that particularly advantageous cartridges can be obtained if two or more of the corresponding elements for pressure regulation are combined since their properties, in particular the advantages and disadvantages thereof, synergistically complement one another.

The above-mentioned objects are correspondingly achieved by cartridges, vaporizer units and vaporizer systems, as they are described herein. Preferred configurations according to the invention will become apparent from the following embodiments.

Such features of cartridges, vaporizer units and vaporizer systems according to the invention which are referred to below as preferred are combined in particularly preferred embodiments with other features referred to as preferred. Combinations of two or more of the cartridges, vaporizer units and vaporizer systems referred to as particularly preferred below are thus very particularly preferred.

The invention relates to a cartridge for an electronic cigarette or a portable inhaler, in particular an inhaler for medical purposes, comprising a rigid reservoir for receiving a liquid, wherein the reservoir has at least one extraction opening which is configured to enable the extraction of liquid from the reservoir, wherein the reservoir comprises one or more elements for pressure regulation in the interior of the reservoir which are arranged in the wall of the reservoir and through which no exit of liquid from the reservoir is possible, wherein the elements for pressure regulation are selected independently of one another from the list comprising non-return valves, gas-permeable but liquid-impermeable diaphragms, and deformable, preferably reversibly deformable, wall portions.

Cartridges according to the invention are suitable for use in electronic cigarettes or portable inhalers and comprise a rigid reservoir in which the liquid to be vaporized can be stored. On the basis of his or her general expertise, the person skilled in the art is able to evaluate whether a reservoir can be referred to as rigid. In the context of the present invention, the expression rigid refers in particular to those reservoirs which, in the case of full-surface application of a pressure of 200 kPa, experience a deformation of 1% or less, preferably 0.1% or less. Examples of rigid reservoirs are known to the person skilled in the art and comprise, for example, reservoirs which are manufactured from glass, metal or non-rubber-elastic plastic.

According to the invention, the reservoir has at least one extraction opening which is configured to enable the extraction of liquids from the reservoir. The reservoirs known from the prior art usually have precisely one such extraction opening through which, in corresponding vaporizer units, a wick material is usually introduced into the interior of the reservoir in order to convey the liquid through this wick material to an electric heating element which is arranged outside the reservoir and is in contact with the wick material.

According to the invention, the reservoir has one or more elements for pressure regulation in the interior of the reservoir which, according to the invention, does not allow any exit of liquid from the reservoir. This means that an element, for example, a hole or gap which is not closed off and through which liquid could escape is not an element for pressure regulation within the meaning of the present invention. According to the invention, corresponding elements for pressure regulation must also be suitable to bring about pressure regulation in the interior of the reservoir, i.e. equalise a pressure difference which occurs with respect to the ambient pressure at least partially, preferably by at least 10%, particularly preferably at least 25%.

The elements for pressure regulation are, according to the invention, arranged in the wall of the reservoir, wherein the term wall can, irrespective of the geometry of the reservoir, also refer to the floor or the ceiling of the reservoir. The term "in the wall of the reservoir" does not mean in the context of the present invention that the element for pressure regulation must lie entirely in the wall. In accordance with expert understanding, an element for pressure regulation is also arranged in the wall of the reservoir if it projects entirely or partially out of the plane of the wall, for example, because it covers a recess arranged in the wall.

According to the invention, the elements for pressure regulation are selected independently of one another. This means that several different elements for pressure regulation can be arranged in the walls of the reservoir.

Non-return valves which are also referred to as 1-way valves represent one possible element for pressure regulation. Non-return valves are known to the person skilled in the art on the basis of his or her general expertise and enable a transport of material in only one direction. Non-return valves then at all times do not allow an exit of liquid from the reservoir if they are arranged in the wall of the reservoir so that the open valve direction runs from the outside into the interior of the reservoir so that, in the event of vacuum pressure in the interior of the reservoir, gas can flow from the outside into the interior of the reservoir to enable pressure equalisation. The reverse path from inside to outside then corresponds to the blocked direction. The person skilled in the art understands in this case that, since the valve only opens in the event of a pressure difference, even in the event of opening of the non-return valve, no exit of liquid from the reservoir through the non-return valve is possible.

Alternatively or additionally, the element for pressure regulation can be a gas-permeable but liquid-impermeable diaphragm. Corresponding diaphragms are familiar to the person skilled in the art on the basis of his or her general expertise and are commercially available since they are used, for example, in physical-chemical separating processes or in the production of functional clothing. Gas-permeable and liquid-impermeable diaphragms can be formed in particular in the case of water as the liquid, for example, by hydrophobic diaphragms. The person skilled in the art can select suitable diaphragms depending on the composition of the liquid which is supposed to be stored in the cartridge. The implicit demand on the diaphragm is that it is liquid-impermeable to the outside at least from the direction of the interior of the reservoir and is gas-permeable at least in one direction, preferably in both directions. Corresponding diaphragms enable an exchange of gas between the interior of the reservoir and the surroundings in at least one direction, usually, however, in both directions, and enable as a result a reduction in overpressures and/or vacuum pressures in the interior of the reservoir.

In turn additionally or alternatively, the element for pressure regulation can also be formed by a deformable, preferably reversibly deformable, wall portion, preferably composed of flexible material. This means that the per se rigid reservoir in a wall has a portion which can be referred to as non-rigid by the selection of a flexible material and/or the formation in a sufficiently thin layer thickness, rather instead is deformable. The term deformable can be qualitatively determined in a clear and unambiguous manner for the person skilled in the art. Within the meaning of the present invention, the term deformable wall portion refers in particular to a wall portion which is formed by the selection of the material and/or the selection of the layer thickness so that it can be deformed in the event of application of a pressure of 1 kPa by 1% or more, preferably 5% or more, particularly preferably 10% or more, wherein the wall portion is preferably reversibly deformable. A deformable wall portion enables an equalisation of overpressures and vacuum pressures which occur in the interior of the reservoir by virtue of the fact that the pressure difference causes the deformation of the corresponding portion and thus increases or reduces the volume available in the reservoir as required, as a result of which a drop in pressure or an increase in pressure is caused.

Cartridges according to the invention are preferred, wherein the reservoir is composed of one or more materials which are selected from the group comprising glass, crystal, metal, ceramic, wood and plastic, preferably glass and plastic, and/or wherein the reservoir is embodied in one piece or two pieces, preferably two pieces, and/or wherein the reservoir is configured so that, in the case of an internal pressure in the reservoir of 120 kPa, preferably 150 kPa, particularly preferably 180 kPa, further preferably 240 kPa, very particularly preferably 480 kPa or more, and an external pressure of 100 kPa, liquid can exit from the reservoir exclusively through the extraction opening.

The materials indicated above are preferred because they are easily available and can be easily and precisely processed with conventional manufacturing methods. The use of glass and plastic is preferred here because these materials not only have particularly high compatibility with the liquid compositions normally used, but also have a comparatively low weight and are often felt to be visually attractive.

It is particularly advantageous from a technical manufacturing perspective to embody the reservoir in multiple pieces, preferably in two pieces, since such reservoirs are often easier to manufacture than a one-piece reservoir which is fully closed with the exception of a (possibly small) extraction opening. For example, a container which is only open on one side can be provided with a cover using conventional fastening means, which cover comprises the extraction opening so that a rigid reservoir for receiving a liquid with an extraction opening is obtained, which reservoir is in principle suitable for use in a cartridge for an electronic cigarette or a portable inhaler.

The reservoir, i.e. including the elements for pressure regulation in the interior of the reservoir, is very particularly preferably configured so that, in the case of the pressure differences defined above, the liquid can exit from the reservoir exclusively through the extraction opening. This means in particular that the reservoir, in the preferred configuration, comprises no intentional leaks, in the case of which a deliberately intended leak can occur at elevated pressures. Corresponding cartridges according to the invention are preferred because in these liquid does not run out from the cartridge even in the case of particularly demanding conditions, for example, in the case of strong sunshine or on board an aeroplane.

Cartridges according to the invention are preferred, wherein the extraction opening is configured to be filled out with a wick material and/or be closed off with a heating unit.

Cartridges according to the invention are preferred, wherein the reservoir comprises a non-return valve, preferably a lip valve, wherein the non-return valve is preferably formed so that it opens in the case of a vacuum pressure in the reservoir with respect to the external pressure of 1 kPa or more, preferably 2 kPa or more, particularly preferably 4 kPa or more, wherein the non-return valve is particularly preferably composed of a flexible material which comprises one or more elastomers which were produced from rubbers which are selected from the group comprising natural rubber and synthetic rubber, are particularly preferably selected from the group comprising natural rubber, styrene-butadiene rubber, polybutadiene rubber, nitrile rubber, chloroprene rubber, ethylene-propylene-diene rubber and silicon rubber.

Corresponding cartridges according to the invention are preferred because the use of non-return valves makes it possible to enable rapid and reliable pressure equalisation in the event of a vacuum pressure occurring in the interior of the reservoir, for example, during vaporization.

Typical non-return valves are known to the person skilled in the art. A lip valve is preferred, wherein in particular those valves have been shown to be particularly advantageous which are composed of a flexible material. Corresponding cartridges according to the invention are also preferred because the non-return valve was shown to be a particularly robust element for pressure regulation in separate field tests, which element reliably satisfies its function in particular in the case of large temperature fluctuations and/or mechanical loads.

It was shown in the separate tests that the non-return valve can also be superior to the use of diaphragms and deformable wall portions in this aspect too. It is, however, felt to be at least partially disadvantageous in comparison with the alternatives stated here that the use of non-return valves is not suitable for counteracting an overpressure which arises in the interior of the reservoir since the arrangement of a non-return valve with a corresponding flow direction from the interior of the reservoir would necessarily lead to a weak point through which at least in principle liquid could also exit from the interior of the reservoir. Non-return valves are preferably used in the preferred cartridges according to the invention, which are formed so that they already open when the pressure in the reservoir lies only slightly below the ambient pressure and thus a comparatively small vacuum pressure is present. As a result of this, the occurrence of small vacuum pressures is also reliably prevented although correspondingly sensitive non-return valves are to some extent associated with higher material costs.

Cartridges according to the invention are preferred, wherein the reservoir comprises a gas-permeable but liquid-impermeable, in particular water-impermeable, diaphragm, preferably a hydrophobic plastic diaphragm, in particular a hydrophobic diaphragm comprising polytetrafluoroethylene, wherein the diaphragm is preferably formed so that it enables the passage of gaseous water and/or gaseous 1,2-propanediol and/or gaseous glycerine.

Corresponding cartridges are preferred because gas-permeable but simultaneously liquid-impermeable diaphragms can reliably hold back the liquid to be stored in the reservoir and at the same time allow an exchange of gas between the interior of the reservoir and the surroundings, usually in both directions. In this regard, the use of these diaphragms is, for example, superior to the exclusive use of a non-return valve to the extent that pressure regulation can be performed in the interior of the reservoir for overpressures and vacuum pressures with the diaphragm. In terms of the alternatives provided in the context of the invention for elements for pressure regulation, in the case of the use of diaphragms, the comparatively high procurement price and the comparatively complicated processing are, however, often felt to be disadvantageous, wherein in particular also the possibly reduced thermal and/or chemical and/or mechanical durability of corresponding diaphragms, for example, in comparison with non-return valves, is felt to be disadvantageous in some cases.

Cartridges according to the invention are preferred, wherein the reservoir comprises a deformable, preferably reversibly deformable, wall portion, preferably composed of or comprising a film, wherein the film is preferably thermally weldable or friction-weldable, for example, polyethylene, and/or a rubber-elastic plastic which comprises one or more elastomers which were produced from rubbers which are selected from the group comprising natural rubber and synthetic rubber, are preferably selected from the group comprising natural rubber, styrene-butadiene rubber, polybutadiene rubber, nitrile rubber, chloroprene rubber, ethylene-propylene-diene rubber and silicon rubber, wherein the deformable wall portion is preferably formed as a deformable bag which projects into the reservoir or projects out of the reservoir, particularly preferably projects into the reservoir, and wherein the volume of the deformable bag without the presence of a pressure difference is preferably smaller than the volume of the reservoir, particularly preferably less than 50%, very particularly preferably less than 25%.

Cartridges according to the invention are alternatively preferred or additionally preferred, wherein the reservoir comprises a deformable, preferably plastically deformable, i.e. non-reversibly or not entirely reversibly deformable, wall portion, preferably comprising a film, preferably comprising polyethylene or one or more other films which are preferably thermally weldable. The deformable wall portion is preferably formed as a deformable bag, preferably as a plastically deformable bag which projects into the reservoir or projects out of the reservoir, particularly preferably projects into the reservoir, and wherein the volume of the bag without the presence of a pressure difference is preferably smaller than the volume of the reservoir, particularly preferably less than 50%.

Corresponding cartridges according to the invention are preferred since it is possible with a corresponding deformable wall portion, preferably composed of flexible material, to counteract an overpressure or vacuum pressure which prevails in the interior of the reservoir in that the deformable wall portion is deformed so that the volume of the interior is reduced or enlarged.

Even when using non-reversibly deformable, i.e. plastically deformable, materials, as a result of this, at least a one-off protective function against significant pressure change in the interior can be realised which can be provided in cartridges according to the invention, for example, as a one-off emergency device. Reversibly deformable wall portions are, however, particularly preferred, i.e. wall portions which can be elastically deformed at least predominantly, preferably entirely, and after the disappearance of the pressure difference can return at least predominantly, preferably entirely, to their original state. As a result of this, it is possible to balance out even changeable pressure fluctuations in each case as necessary.

In principle, it is possible to provide a wall portion which is flush with the rest of the wall of the reservoir, which wall portion is formed to be deformable by the selection of a suitable flexible material and/or by the selection of an adequately thin wall thickness. It has, however, been shown in practice that the surface of corresponding portions must often have dimensions which are too small on technical production grounds in order to enable sufficient deformation while maintaining the liquid-impervious property, which deformation could significantly compensate for the pressure fluctuations which occur during operation. The volume which is additionally available as a result of deformation is often too small in these systems in order to entirely prevent a negative influence of pressure fluctuations on the liquid supply at the heating unit.

It is correspondingly particularly preferred that the deformable wall portion is formed as a deformable, preferably reversibly deformable, bag which projects into the reservoir or projects out of the reservoir. This deformable bag is exposed to the external pressure on the side facing away from the interior and can be expanded or compressed as a function of the pressure fluctuations which occur in the interior of the reservoir in order to compensate for these pressure fluctuations. As to whether a compression or expansion of the bag occurs as a result of an increase in pressure or a reduction in pressure, this depends on whether the bag projects into the reservoir or projects out of the reservoir. For example, an increase in pressure in the interior of the reservoir in the case of a projecting flexible bag leads to a compression of the bag, along with simultaneous, pressure-free escape of air on the side of the bag facing the surroundings.

It is preferred in this case that the reversibly deformable bag projects into the interior of the reservoir, which is not only on visual grounds. As a result of the arrangement in the interior of the reservoir, it is more easily possible to protect the bag from damage, as can occur, for example, in the case of contact with foreign bodies. This, however, also means that, since the bag should be at least partially expanded during filling of the cartridge in order to enable sufficient deformation without being pushed out of the reservoir, the volume available in the interior of the reservoir for the liquid to be vaporized is reduced.

One possible production method can preferably comprise the following steps: Shaping a thermoplastic strand of film, wherein a plurality of open bag portions are formed, welding the shaped strand of film with the plurality of open bag portions with a second film in such a manner that the bag portions form together with the second film a plurality of preferably closed bubbles on the strand of film, punching out the bubbles from the strand of film. For example, the second film can have a greater thickness than the thickness of the strand of film. The shaping is preferably performed by deep drawing or associated methods.

Alternatively or in addition to the bubbles produced in the production method and present in the strand of film, the step of fastening a plastic part, preferably a rigid plastic part, for example, a frame, a receiver or a flange, can be performed, wherein the fastening is preferably performed by thermal welding or friction welding. The punching out of the bubbles with the plastic part can be performed in this case after the step of fastening the plastic part.

The bubbles produced according to this exemplary method can be mounted as follows in a cartridge according to the invention: Arranging at least one bubble in a or outside on a reservoir, wherein the bubble covers a passage which provides a communicating connection between the interior of the reservoir and a region outside the reservoir which is in contact with the ambient pressure, Welding, preferably thermal welding or friction welding, of the bubble and/or, where present, of the plastic part of the bubble in the region of the passage so that the welded bubble and/or the welded plastic part fully seal(s) off the passage, opening the bubble in the region of the passage, wherein the passage thus provides a communicating connection between the ambient pressure and the volume enclosed by the bubble and separated from the interior of the reservoir and thus a deformable bag described above is formed in the reservoir or the cartridge.

The opening can preferably be performed by a perforation of the bubble, for example, a puncturing of the bubble with a needle or another suitable, sharp object. The portion of the bubble with the second film is preferably configured to be flat or corresponding to the region of the passage, covers the passage and is welded there, possibly together with the plastic part or independently thereof. The bubble or the plastic part can further preferably be welded over the full surface in the region of the passage. Alternatively, the bubble can also be welded only along a closed, circumferential contour around the passage with the reservoir.

The bag and/or the volume enclosed by the bag can preferably change in the case of pressure differences which are present between the interior of the reservoir and the ambient pressure, of less than 10 hPa, preferably less than 5 hPa, preferably reversibly, i.e. elastically, or entirely or partially non-reversibly, i.e. plastically, preferably at least not entirely reversibly. This change in volume preferably occurs as a result of the change in pressure difference and is substantially free from restoring forces generated by the material of the bag.

If exclusively a deformable wall portion is used as an element for pressure regulation, cartridges according to the invention are preferred, wherein the volume of the deformable wall portion lies, in the presence of a pressure difference of 38 kPa, in the range from 30 to 90% of the initial volume of the reservoir, preferably 40 to 80%, particularly preferably 50 to 70%. As a result of this, it is ensured that even in the case of almost complete emptying of the reservoir by the deformable wall portion sufficient equalising volume can still be made available without the deformable wall portion being able to take up so much space that the remaining fluid can no longer travel unhindered to the extraction opening.

Cartridges according to the invention are very particularly preferred, wherein the reservoir comprises two or more elements for pressure regulation, preferably two, and/or wherein the reservoir comprises two or more different elements for pressure regulation, preferably two, and/or wherein the reservoir comprises two or more elements for pressure regulation, preferably two, which are arranged on the same or on different sides of the reservoir, preferably on the same sides.

The preferred cartridges are thus in particular preferred because, as a result of the combination of two or more elements, in particular two or more different elements, the characteristics of the pressure regulation can be adapted specifically to the demands which arise in the respective field of application, wherein in particular also existing weaknesses of the individual elements for pressure regulation can be compensated for in a synergistic manner. It is thus, for example, particularly advantageous to combine the non-return valve, which offers no solution for overpressures in the interior of the reservoir, with a deformable wall portion or a diaphragm which enable this pressure regulation. At the same time, the non-return valve represents a particularly robust and reliable solution in order in the case of doubt to provide large quantities of gas even for a short period of time into the interior, as, for example, the diaphragm is unable to in some cases.

It has been demonstrated in some tests that the use of a diaphragm in particular to cushion small changes in pressure is particularly expedient, wherein it is advantageous to protect the diaphragm from mechanical load by virtue of the fact that this is combined with a non-return valve or a deformable wall portion which can react particularly rapidly even to large changes in pressure.

The combination of a non-return valve with a deformable wall portion is particularly advantageous because the maximum expansion volume of the bag and thus its space requirement in the interior of the reservoir do not have to be provided in such a magnitude that even significant vacuum pressures can be compensated for. In the event of more significant vacuum pressures occurring, additional gas can penetrate into the interior by way of the non-return valve so that a particularly significant expansion of the deformable wall portion is not necessary. In other words, this means that, in the combination of the two elements for pressure regulation, the threshold value for the non-return valve can be set higher, whereas the maximum expansion volume of the deformable wall portion can be selected to be lower. The costs and the manufacturing outlay of the two components are reduced by both aspects.

Cartridges according to the invention are correspondingly preferred, wherein the reservoir comprises a non-return valve and a gas-permeable but liquid-impermeable diaphragm, and/or wherein the reservoir comprises a non-return valve and a deformable wall portion, preferably a reversibly deformable bag, and/or wherein the reservoir comprises a gas-permeable but liquid-impermeable diaphragm and a deformable wall portion.

Cartridges according to the invention are preferred, wherein the one or more elements for pressure regulation are arranged in the wall of the reservoir which has on average the largest distance to the extraction opening, and/or wherein the distance between the extraction opening and the one or more elements for pressure regulation is larger than the average diameter of the extraction opening.

Corresponding cartridges are preferred because it is to be assumed in typical vaporizer systems that the heating unit and/or the wick material are arranged in the vicinity of the extraction opening and/or even project through this into the interior of the reservoir. It is often to be recommended for friction-free operation of such vaporizer systems that the supply of liquid to the wick material can take place in an unrestricted manner and there is as large as possible a contact surface between the wick material and the liquid. This can in principle be impaired by gas bubbles which penetrate through an adjacent non-return valve or a deformable wall element which expands significantly in the vicinity. It is thus advantageous not to provide the elements for pressure regulation in the vicinity of the wick material because the incoming gas or the expanding deformable wall portion thus cannot block or occupy the contact surface between the liquid and the wick material.

Moreover, typical vaporizer systems are often designed such that, in the case of the intended use of vaporization, the extraction opening is covered with liquid. It is correspondingly significantly easier to realise in preferred cartridges that the elements for pressure regulation are not covered by liquid at the moment of use and a friction-free exchange of gas, above all things in the case of the non-return valve and the diaphragm, or an expansion which is not restricted by the composition, in particular in the case of the deformable wall portion, is possible.

Cartridges according to the invention are preferred, comprising in the reservoir a composition, wherein the composition comprises at least one active ingredient component, at least one carrier substance which boils at a higher temperature than the active ingredient component and at least one second carrier substance which boils at a lower temperature than the active ingredient component, wherein the active ingredient component preferably comprises nicotine, tetrahydrocannabinol, cannabidiol or substances of the corresponding substance classes and the composition preferably furthermore comprises one or more solvents selected from the group comprising 1,2-propanediol, glycerine and water.

Corresponding cartridges according to the invention are preferred because the provision of already filled cartridges makes it possible to provide single-use parts which only have to be combined with a reusable part by the user of corresponding vaporizer systems in order to generate a functioning vaporizer system. In practice, the composition defined above has been shown to be particularly advantageous.

The invention furthermore relates to a vaporizer unit, comprising a cartridge according to the invention, additionally comprising a heating unit with a wick material and with an electric heating element which is arranged so that the wick material is arranged in the extraction opening and/or covers the extraction opening and that liquid can travel from the reservoir via the wick material to the electric heating element.

As a result of the combination of a cartridge according to the invention with a heating unit comprising a wick material and electric heating element, a vaporizer unit according to the invention is obtained which is suitable for vaporizing a composition stored in the reservoir. According to the invention, the wick material is arranged in the extraction opening or covers the extraction opening in such a manner that liquid can travel from the reservoir via the wick material to the electric heating element. In conventional wick-coil systems, the electric heating element is formed, for example, by a heating coil through which the wick material is guided, the two ends of which project through the extraction opening into the liquid reservoir. In the filled state, the wick material is fully absorbed by the capillary effect with the composition to be vaporized and correspondingly has pores or capillaries filled with liquid. In order to prevent unintentional leakage through the extraction opening, the extraction opening is often filled or covered so imperviously with the wick material that no fluid-conducting connection between the interior of the reservoir and the exterior of the reservoir past the wick material is possible. Liquid can correspondingly travel from the reservoir only via the wick material to the electric heating element. This has the effect in the case of conventional cartridges that pressure regulation is not possible via the extraction opening or only to a limited extent such that a vacuum pressure in the interior of the reservoir leads to insufficient composition travelling via the wick material to the heater chip, whereas an overpressure in the reservoir can lead to composition travelling in undesirably high quantities through the wick material to the heating unit. The vaporization result would be impaired in both cases. In vaporizer units according to the invention which comprise a cartridge according to the invention, this disadvantageous effect is prevented since an overpressure or vacuum pressure in the interior of the reservoir can advantageously be equalised by the one or more elements for pressure equalisation.

Vaporizer units according to the invention are preferred, wherein the electric heating element is a wire coil or a heater film or a plate-shaped heater chip, preferably a heater film or a plate-shaped heater chip, particularly preferably a plate-shaped heater chip composed of a doped or undoped semiconductor material which is crossed by a plurality of microchannels which provide a liquid-conducting connection between the side of the heater chip facing the wick material and a side of the heater chip facing an air channel (36).

So-called wick-coil systems, in which the electric heating element is formed by a wire coil, are currently the most commonplace systems for vaporizer units and are advantageous at least in so far as they are technologically comparatively simple and can often be manufactured easily and at low cost. It is, however, often felt to be disadvantageous in the case of wick-coil systems that the reproducibility of the vaporization process and the quality of the aerosol generated is sometimes felt be disadvantageous. New technologies were therefore developed in recent years, in the case of which a plate-shaped heater chip or a heater film can be used as the electric heating element, which can be covered with the wick material and can optionally be fixed on a rigid carrier. It is known from the prior art that corresponding heater films or plate-shaped heater chips lead to a particularly efficient, controllable and reproducible vaporization process and thereby generate an aerosol with particularly high quality which is felt by many consumers to be particularly pleasant.

The heating unit composed of the heater film or the plate-shaped heater chip as well as the wick material are normally placed in these structures on the extraction opening of the reservoir, wherein a fluid-impervious connection is generated by sealing elements so that liquid and gases can escape from the interior of the reservoir only through the extraction opening and in this case exclusively through the wick material and the heating unit.

Vaporizer units according to the invention are correspondingly preferred, wherein the heating unit comprises sealing elements to enclose the electric heating element and is connected to the reservoir in a fluid-impervious manner at the extraction opening in such a manner that liquid and/or gas can escape from the interior of the reservoir through the extraction opening exclusively through the heating unit.

Corresponding vaporizer units according to the invention are preferred because the general structure in practice has been shown to be particularly effective and robust. It has simultaneously been shown in the case of these systems in which the extraction opening is connected in a fluid-impervious manner to the heating unit and as a result is closed off in a fluid-impervious manner apart from the passage that there is particularly great susceptibility to the occurrence of overpressures and vacuum pressures. This is due to the fact the pressure equalisation through the extraction opening is not only impaired by the wick material, but rather that the heating unit also represents a significant barrier to pressure equalisation. These vaporizer units are correspondingly also preferred because the technical effect of the configuration according to the invention is particularly noticeable in these.

Vaporizer units according to the invention are preferred, wherein the electric heating element and/or the wick material are configured so that they do not allow any passage of liquid through the extraction opening and through the heating element up to a pressure difference between the internal pressure in the reservoir and the external pressure of 1 kPa, preferably 2 kPa, particularly preferably 3 kPa.

In tests of the inventors themselves, it has been shown that it is particularly advantageous to configure the electric heating element and/or the wick material so that no passage of liquid through the extraction opening through the heating element is still possible at least in the case of small pressure differences between the interior of the reservoir and the surroundings. The person skilled in the art can make this adjustment, for example, by the selection of suitable pore sizes for the wick material. Alternatively, this adjustment can be made when using a plate-shaped heater chip, by the adjustment of the diameter of the microchannels. In these microchannels which cross the heater chip or the pores, a resistance to the exit of fluid results from the surface tension of the liquid, which resistance prevents unintentional running out of the liquid at least in the case of small pressure differences between the internal pressure in the reservoir and the external pressure. Corresponding vaporizer units are therefore particularly preferred because the base tolerance set as a result of this of the system to pressure fluctuations in the interior of the reservoir makes it possible to have to configure the elements for pressure regulation less sensitively without the supply of liquid to the electric heating element being excessively impaired as a result. As a result of this, it is possible that the advantageous effect of the invention is even achieved if the selected element for pressure regulation only leads to a pressure equalisation from a higher pressure difference, for example, when using a non-return valve, and/or possibly reacts more slowly to changes in pressure, as can occur, for example, in the case of certain diaphragms.

Vaporizer units according to the invention are preferred, wherein the reservoir is configured to be cylindrical or rectangular and the extraction opening is arranged on a vent which extends from one of the base areas of the cylinder or rectangle into the interior of the cylinder or rectangle, preferably through the entire reservoir.

In the arrangement described above, the extraction opening lies quasi in the interior of the reservoir, from where a vent extends towards the outside of the reservoir. A corresponding structure is obtained, for example, in that a cylindrical reservoir composed of plastic or metal which has on its two base areas in each case a recess is combined with a plastic or metal tube with an extraction opening which is introduced into the first recess and guided through the cylinder through the second recess until it is fixed in this position. Corresponding vaporizer units are particularly advantageous in the context of the present invention because as a result of this a portion of the reservoir is formed in the reservoir to the side of the vent, on the side facing away from the extraction opening, in which portion of the reservoir elements for pressure regulation can be arranged particularly expediently because an impairment of the extraction opening by the elements for pressure regulation is ruled out, for example, as a result of a reversibly deformable component with a changing volume or as a result of the air flowing in through a non-return valve.

The invention furthermore relates to a vaporizer system for vaporizing a composition, preferably for use in a portable vaporization apparatus, preferably in a handheld device, particularly preferably in an E-cigarette or an inhaler for medical purposes, comprising a cartridge according to the invention and a heating unit or a vaporizer unit according to the invention and at least one electric energy source for operation of the electric heating element.

The combination of a cartridge according to the invention as well as a heating unit or alternatively the use of a vaporizer unit according to the invention make it possible to obtain a vaporizer system according to the invention for vaporizing a composition, wherein an electric energy source makes available the energy required for operation of an electric heating element.

It is very particularly preferred to embody the vaporizer system in two parts, wherein the cartridge is arranged in a first part, a so-called single-use part, and the electric energy source is arranged in a second part, a so-called reusable part. When using the vaporizer system according to the invention, a filled cartridge can be connected to the reusable part, i.e. to a liquid composition in the reservoir, in order to make the vaporizer system ready for use. After emptying the reservoir, the single-use part can be removed and replaced by a new, filled cartridge in order to immediately re-establish the ability to use the vaporizer system.

Various configurations are possible in this case, wherein in particular the electric heating element can be arranged either in the first part or in the second part, i.e. is either a component of the single-use part, or can be used multiple times together with the electric energy source. Alternatively, a third part which comprises the heating unit and/or further elements, for example, sensors, can also be provided in the vaporizer system according to the invention.

Vaporizer systems according to the invention are correspondingly preferred, wherein the cartridge according to the invention is arranged in a first part, in particular a single-use part, and the electric energy source is arranged in a second part, in particular a reusable part, wherein the first part and the second part are connected to one another detachably in a reversible and destruction-free manner so that there is electric contact between the electric energy source and the electric heating element as well as a fluid-conducting contact between the reservoir and the electric heating element.

Vaporizer systems according to the invention, additionally comprising a third part, are also correspondingly preferred, wherein the heating unit is arranged in the first part or in the second part or in the third part, wherein the first part, the second part and the third part are connected to one another detachably in a reversible and destruction-free manner so that there is electric contact between the electric energy source and the electric heating element as well as a fluid-conducting contact between the reservoir and the electric heating element.

In the context of the present invention, two parts which cannot be detached from one another in a reversible and destruction-free manner and can be connected again by the user applying normal forces, i.e. forces which can be applied with the hands, possibly using a tool such as, for example, a screwdriver, are not regarded as being connected to one another detachably in a reversible and destruction-free manner. In the context of the present invention, the expression detachably in a reversible and destruction-free manner relates to the component used for connection and/or fastening, for example, the screw thread. It is not ruled out that intentional changes occur in the first and/or second part prior to or during connection of the first and second part, which, however, do not influence the connectibility and detachability. For example, it may be necessary to remove a protective film from the first part prior to connection. In some preferred embodiments, the second part comprises, for example, a spike or a similar structure with which a protective film fastened to the first part is deliberately punctured during connection.

Vaporizer systems according to the invention are preferred, wherein one or more elements for pressure regulation are arranged in the cartridge such that these are not arranged on or in the outer sleeve of the vaporizer system.

Corresponding vaporizer systems according to the invention are particularly tried and tested in practice and have been shown to be advantageous because it is expedient to arrange the elements for pressure regulation in the cartridge in such a manner that these, in the case of the obtained vaporizer system according to the invention, are not arranged on the outer sleeve of the vaporizer system. This means, for example, that the elements for pressure regulation are arranged within the vaporizer system according to the invention, for example, below a casing and/or an outer sleeve so that they are protected from mechanical damage, in particular as a result of the unintended action of the consumer, in the event of use of the vaporizer by the end user. Even if this may be advantageous for certain applications, it has been shown to be disadvantageous in some cases if the user, when using the vaporizer system according to the invention, can, for example, accidentally close the non-return valve with a finger or can damage the diaphragm or a deformable wall portion, for example, with finger nails.

Vaporizer systems according to the invention are preferred, wherein the electric energy source is an energy store, preferably a battery or a fuel cell, particularly preferably a lithium ion battery, in particular a lithium polymer accumulator, and/or additionally comprising an electronic control apparatus for controlling the electric heating unit, and/or additionally comprising one or more sensor units, wherein the one or more sensor units are selected from the group comprising radiation sensors, in particular infrared sensors, temperature sensors, pressure sensors, flow sensors, current measurement devices, voltage measurement devices, position sensors, mass flow sensors, volumetric flow sensors, fill level sensors to determine the fill level in the tank, optical sensors, chemical sensors, chemical analysis apparatuses.

BRIEF DESCRIPTION OF THE DRAWINGS

The invention and preferred embodiments of the invention are explained and described in greater detail below with reference to the accompanying figures. In this case, identical reference numbers in different figures designate identical components.

In the figures.

DETAILED DESCRIPTION OF THE INVENTION

Figure 1:
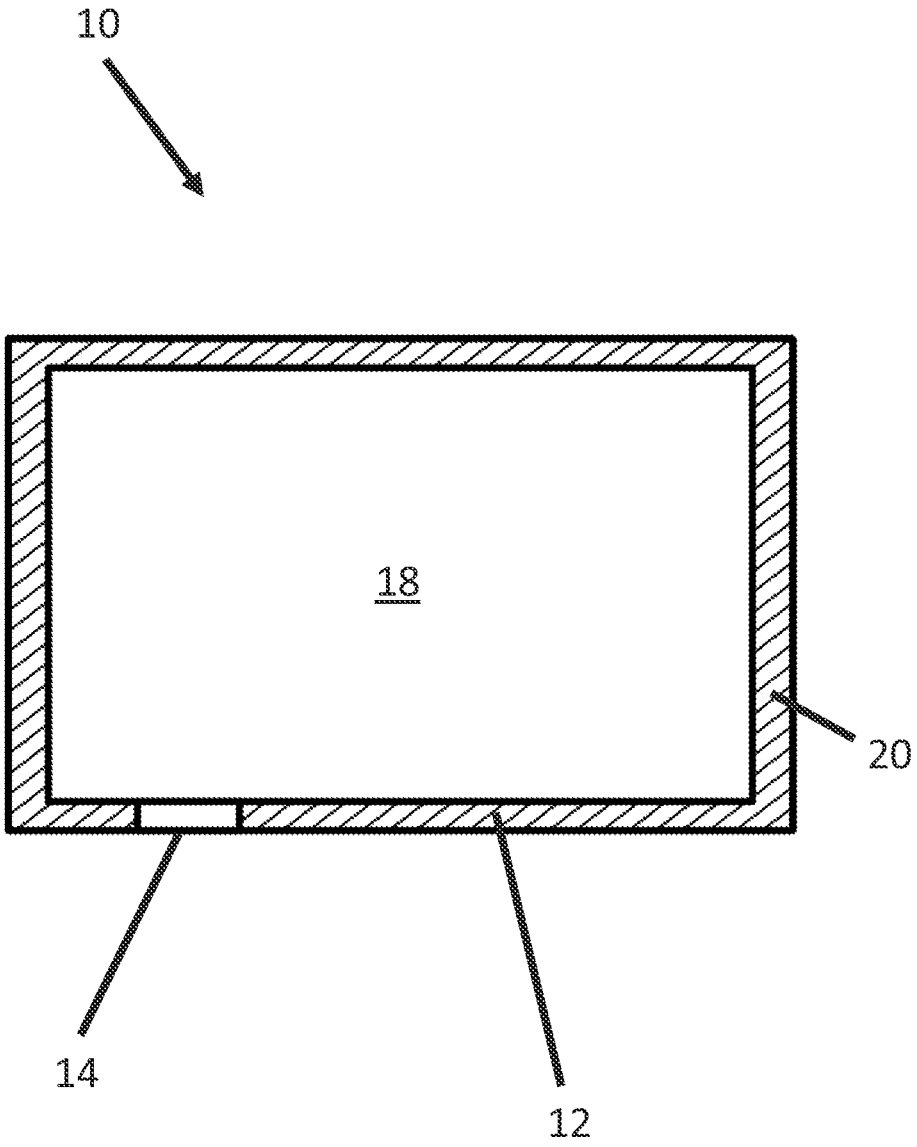
FIG. 1 shows the schematic representation of a cross-section through a cartridge known from the prior art.

FIG. 1 shows a schematic representation of a cross-section through a cartridge 10 known from the prior art. This cartridge 10 is composed in this simple embodiment of a rigid reservoir 12, wall 20 of which encloses interior 18 of reservoir 12. Represented reservoir 12 has an extraction opening 14 which is configured to enable the extraction of liquid from reservoir 12. Reservoir 12 known from the prior art has no elements for pressure regulation 16 in interior 18 of reservoir 12. In the case of these cartridges known from the prior art, extraction opening 14 is filled out by a wick material and/or closed off with a heating unit 30 during operation in a vaporizer unit so that a pressure difference which occurs in interior 18 of reservoir 12 in comparison with the ambient pressure disadvantageously leads to an insufficient amount of composition reaching the electric heating element via the wick material or the liquid being transported through the wick material in an undesirable quantity to heating unit 30.

Figure 2:
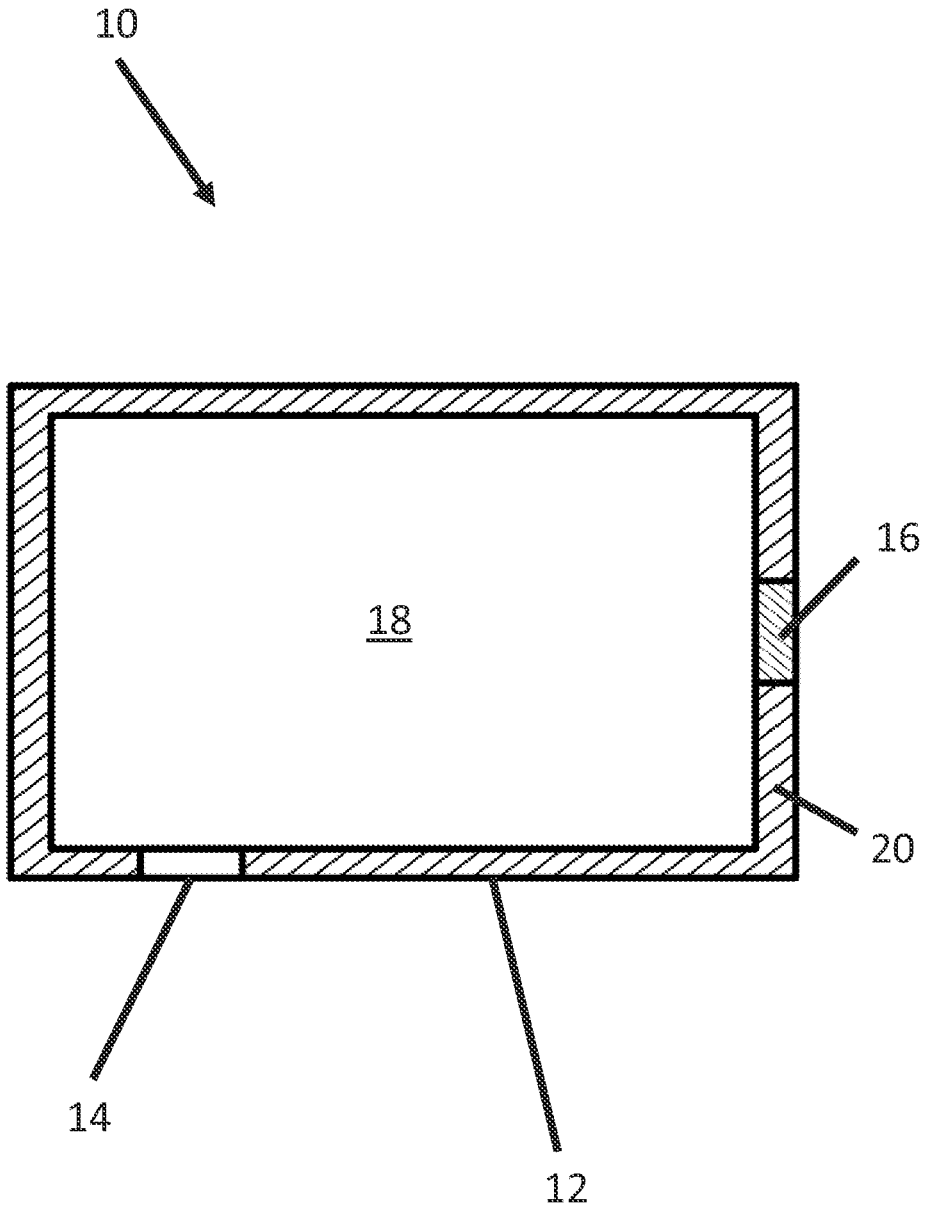
FIG. 2 shows the schematic representation of a cross-section through a cartridge according to the invention.

FIG. 2 shows in contrast to this a schematic representation of a cross-section through a cartridge 10 according to the invention, rigid reservoir 12 of which in wall 20 comprises an element for pressure regulation 16 in interior 18 of reservoir 12. As a result of this, it is possible to compensate for pressure differences which occur in interior 18 of reservoir 12 via the element for pressure regulation 16 so that the exit of liquid though extraction opening 14 to a heating unit (not shown) is not impaired. Cartridge 10 according to the invention and shown in FIG. 2 is in the present example formed exclusively by rigid reservoir 12 which is composed in the present example of plastic and is embodied in one piece.

Reservoir 12 shown has no portions in the case of which intentional leaks occur in the case of an increase in internal pressure. This means that reservoir 12 is impervious in the case of an internal pressure of 120 kPa and an external pressure of 100 kPa apart from extraction opening 14 so that liquid can escape from reservoir 12 exclusively through extraction opening 14 even in the case of these elevated pressures.

Extraction opening 14 shown is configured to be filled out with a wick material (not shown) and/or closed with a heating unit (not shown). The cartridge according to the invention and disclosed in FIG. 2 is configured so that the element for pressure regulation 16 is arranged in wall 20 of reservoir 12 which has the greatest distance to extraction opening 14, wherein the distance between extraction opening 14 and the element for pressure regulation 16 is greater than the average diameter of extraction opening 14 so that the faults potentially caused by the element for pressure regulation 16, for example, the ingress of gas or the expansion of a deformable wall portion, influence the region of cartridge 10 which is vital for consistent and controlled liquid supply to heating element 30 as little as possible.

Figure 3:
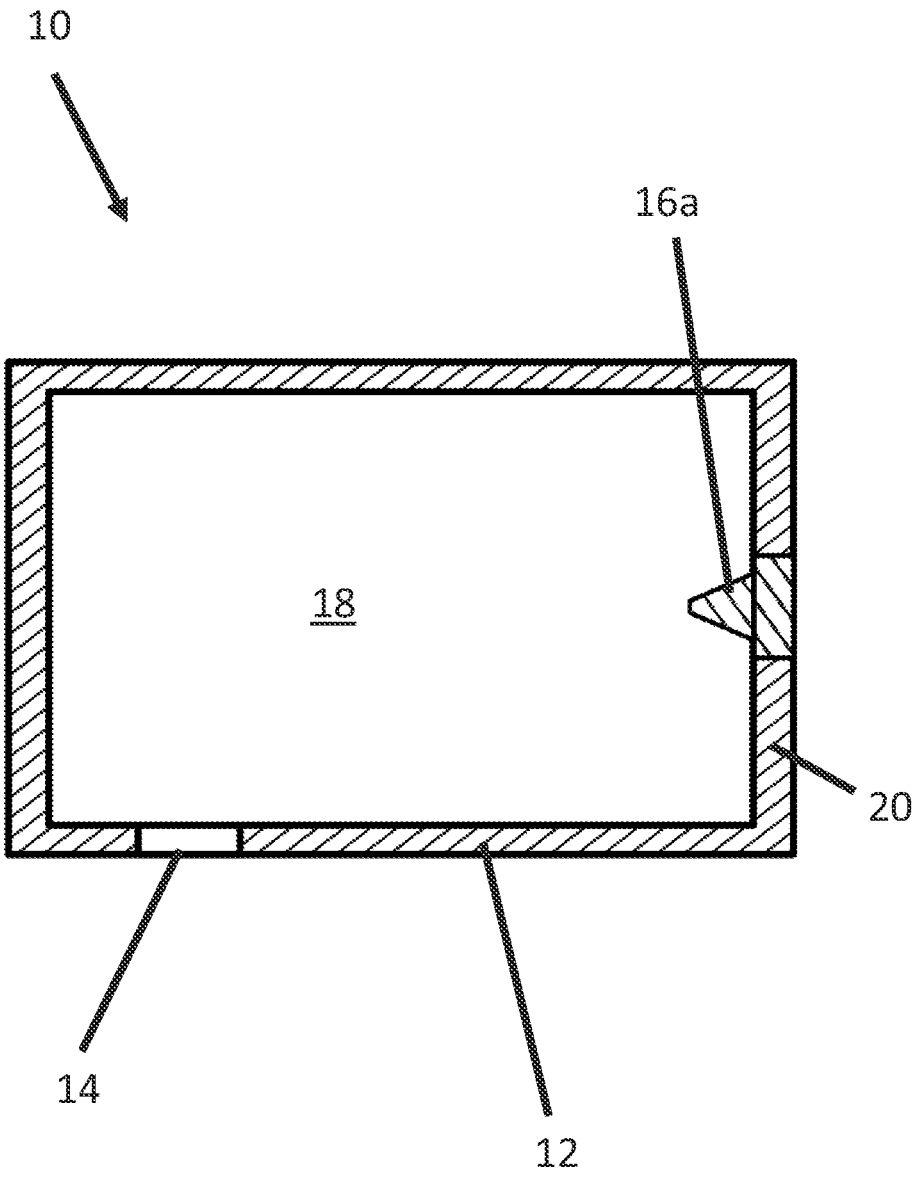
FIG. 3 shows the schematic representation of a cross-section through a cartridge according to the invention in a first preferred embodiment.

FIG. 3 shows a schematic representation of a cross-section through a cartridge 10 according to the invention in one preferred embodiment. As an element for pressure regulation 16, reservoir 12, arranged in wall 20 of reservoir 12, comprises a non-return valve **16*a*, which in the present example involves a lip valve. This lip valve is configured so that it opens in the case of a vacuum pressure in the reservoir with respect to the external pressure of 1 kPa or more and as a result of this enables a pressure equalisation with the surroundings. In FIG. 3, non-return valve 16*a* is composed of a flexible material which comprises an elastomer which was produced from silicon rubber. Since non-return valve 16*a* only opens if there is a pressure difference between interior 18 of reservoir 12 and the surroundings, no exit of liquid from reservoir 12 is possible through non-return valve 16*a***.

Figure 4:
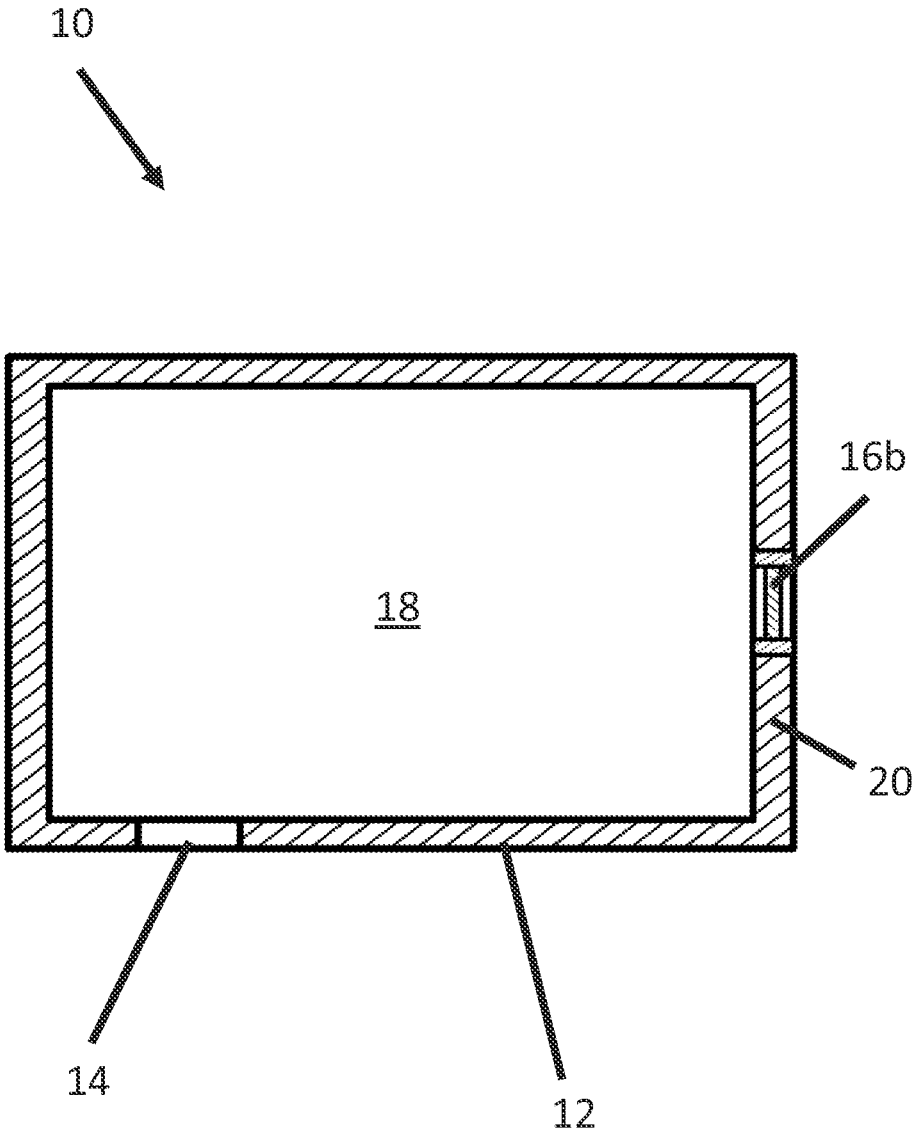
FIG. 4 shows the schematic representation of a cross-section through a cartridge according to the invention in a second preferred embodiment.

FIG. 4 shows a schematic representation of a cross-section of a further preferred embodiment of cartridge 10 according to the invention, wherein the element for pressure regulation 16 is a gas-permeable but liquid-impermeable diaphragm 16*b*. In FIG. 3, gas-permeable but liquid-impermeable diaphragm 16*b* is a hydrophobic plastic diaphragm composed of polytetrafluoroethylene which is formed so that it prevents the passage of water, 1,2-propanediol and glycerine from interior 18 of reservoir 12 and prevents the exchange of gas between interior 18 of reservoir 12 and the surroundings in both directions.

Figure 5:
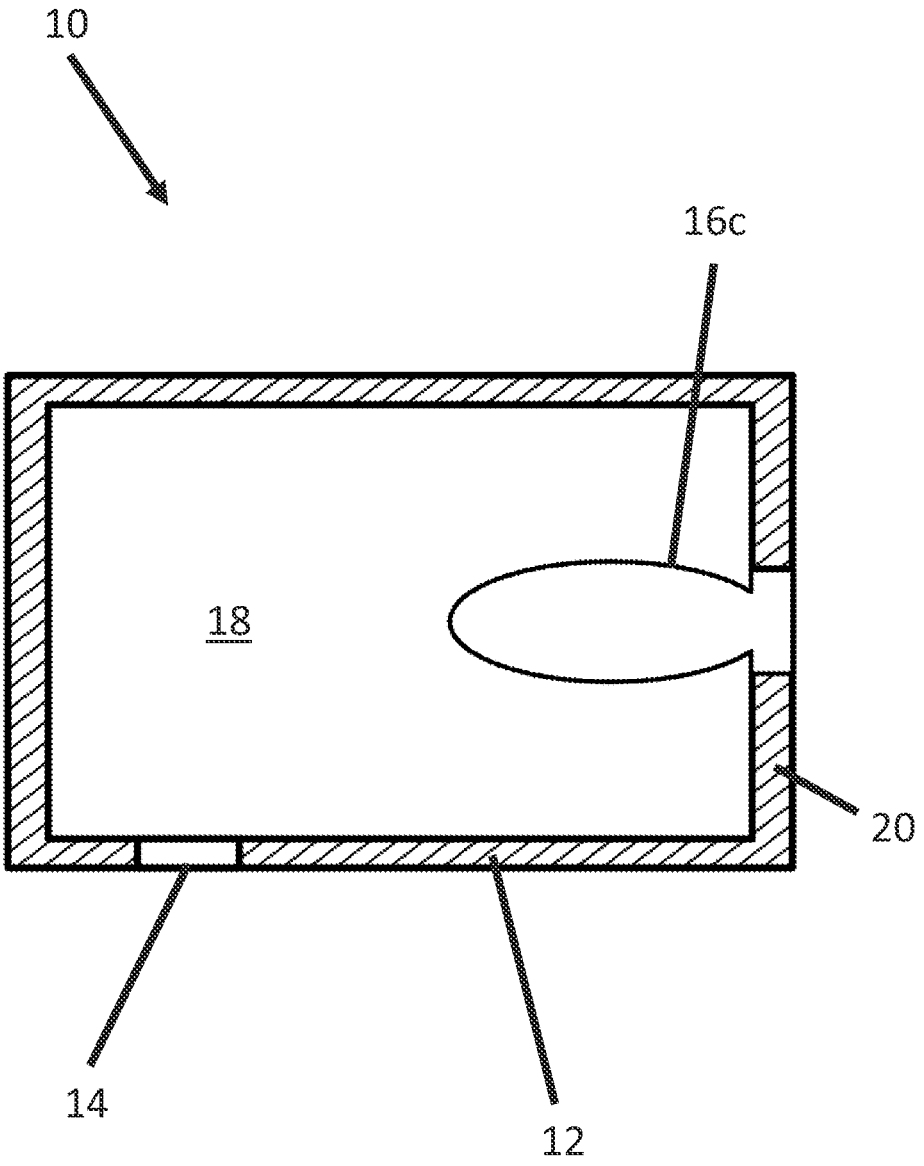
FIG. 5 shows the schematic representation of a cross-section through a cartridge according to the invention in a third preferred embodiment.

FIG. 5 shows a schematic representation of a cross-section through a cartridge 10 according to the invention in a further preferred embodiment. The element for pressure regulation 16 is formed in this embodiment by a deformable wall portion 16*c*, wherein the embodiment shown in FIG. 3 comprises a reversibly deformable wall portion 16*c* which is formed as a deformable bag which projects into reservoir 12. The side of deformable wall portion 16*c* facing away from interior 18 of reservoir 12 is in contact with the surroundings and correspondingly has ambient pressure, without, however, enabling the exit of liquid through deformable wall portion 16*c*. Deformable wall portion 16*c* can correspondingly be compressed or expanded as a function of a change in pressure in interior 18 of reservoir 12 in order to balance out this change in pressure.

Figure 6:
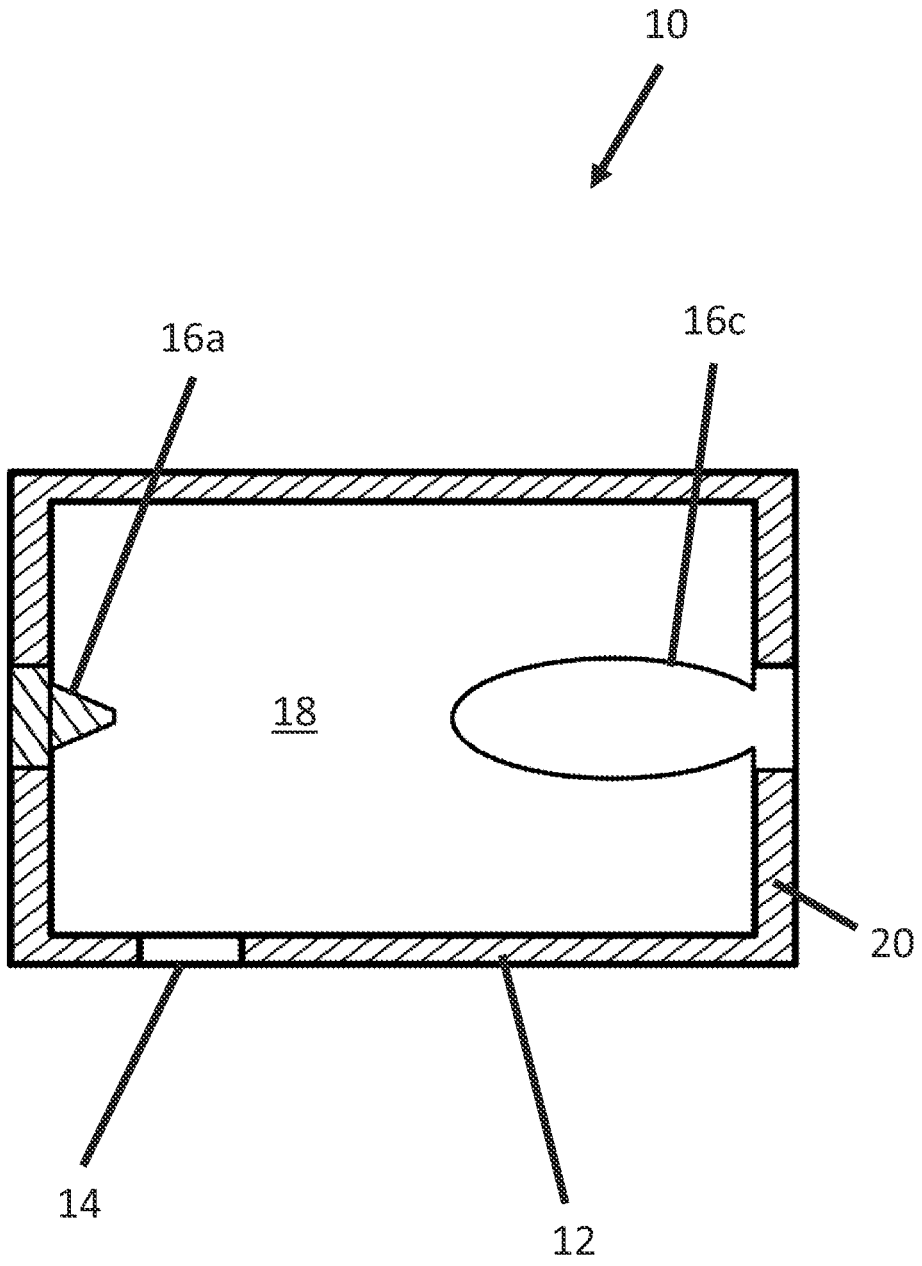
FIG. 6 shows the schematic representation of a cross-section through a cartridge according to the invention in a fourth preferred embodiment.
Figure 7:
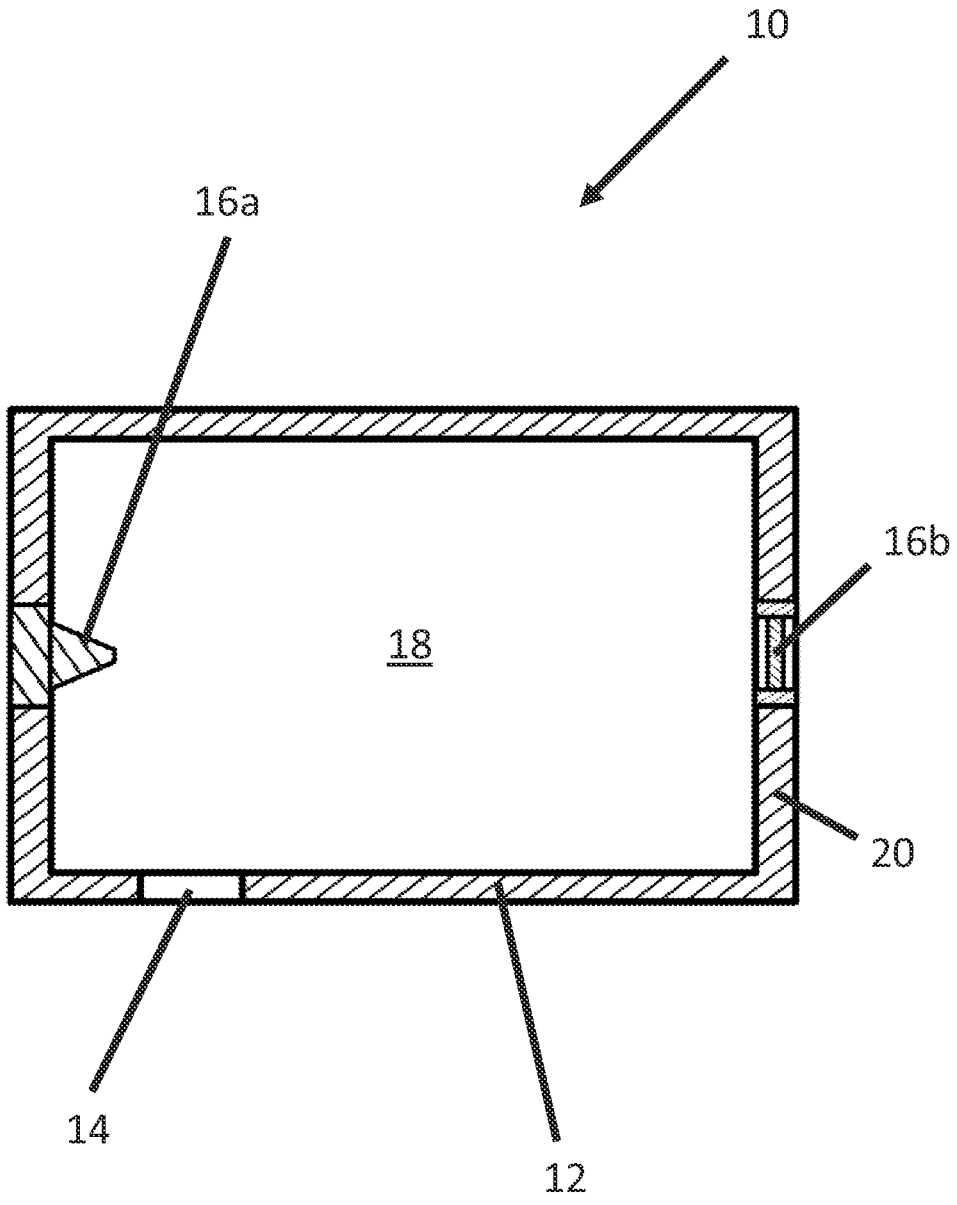
FIG. 7 shows the schematic representation of a cross-section through a cartridge according to the invention in a fifth preferred embodiment.

FIGS. 6 and 7 show in each case a schematic representation of a cross-section through two particularly preferred embodiments of cartridge 10 according to the invention which are particularly advantageous because they enable the synergistic interaction of two elements for pressure regulation 16, which involve different elements for pressure regulation 16, which are arranged on different sides of reservoir 12, i.e. are arranged in different portions of wall 20.

In the two represented embodiments, reservoir 12 comprises in each case a non-return valve 16*a* which is provided in particular to balance out large vacuum pressures which occur in interior 18 of reservoir 12 in a speedy manner in order as a result to support and protect the respective second element for pressure regulation 16 and obtain greater flexibility in terms of the design of the second element for pressure regulation 16. In FIGS. 6 and 7, the second element for pressure regulation 16 is configured once as a deformable wall portion 16*c*, which is configured as a reversibly deformable bag, or as a diaphragm which is gas-permeable but liquid-impermeable. These elements for pressure regulation 16 each have the task of compensating for the increases in pressure which occur in interior 18 of reservoir 12 and prevent those vacuum pressures which are not sufficient to bring about an opening of non-return valve 16*a*.

FIGS. 8 to 12 show in each case a schematic representation of a cross-section through a vaporizer unit 34 according to the invention in preferred embodiments. Vaporizer unit 34 comprises in each case a cartridge 10 according to the invention. Reservoir 12 is in this case embodied in two parts and is cylindrical. A vent 40 which surrounds an air channel 36 extends through reservoir 12 in this configuration from one base area 42 to the other. Arranged on this vent 40, vaporizer unit 34 according to the invention comprises a heating unit 30 which comprises a wick material and an electric heating element (not shown). Heating unit 30 is arranged in extraction opening 14 so that the wick material is arranged in extraction opening 14 and so that the liquid can travel from reservoir 12 via the wick material to the electric heating element.

In the embodiments shown, the electric heating element used involves a plate-shaped heater chip, composed of a doped semiconductor material which is crossed by a plurality of microchannels which provide a liquid-conducting connection between the side of the heater chip facing the wick material and a side of the heater chip facing air channel 36.

Disclosed heating unit 30 comprises sealing elements in order to enclose the electric heating element and is connected at extraction opening 14 to reservoir 12 in a fluid-impervious manner so that liquid and gas can exit from interior 18 of reservoir 12 through extraction opening 14 exclusively through heating unit 30, i.e. the wick material and the electric heating element. In the represented embodiments, the electric heating element and the wick material are jointly configured so that they do not allow any passage of liquid through extraction opening 14 and through heating element 30 up to a pressure difference between the internal pressure in reservoir 12 and the external pressure of 1 kPA.

Figure 8:
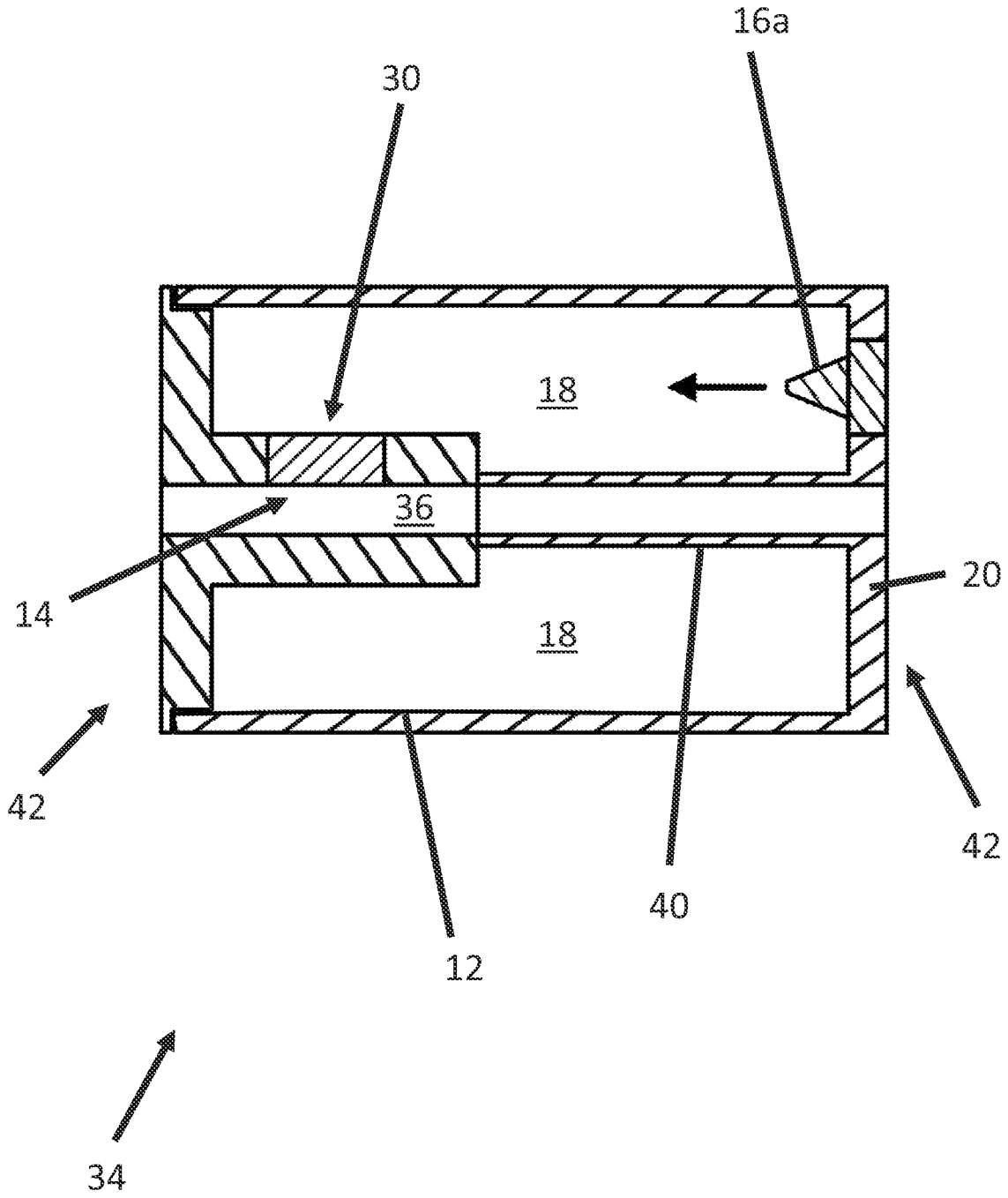
FIG. 8 shows the schematic representation of a cross-section through a vaporizer unit according to the invention in a first preferred embodiment.
Figure 9:
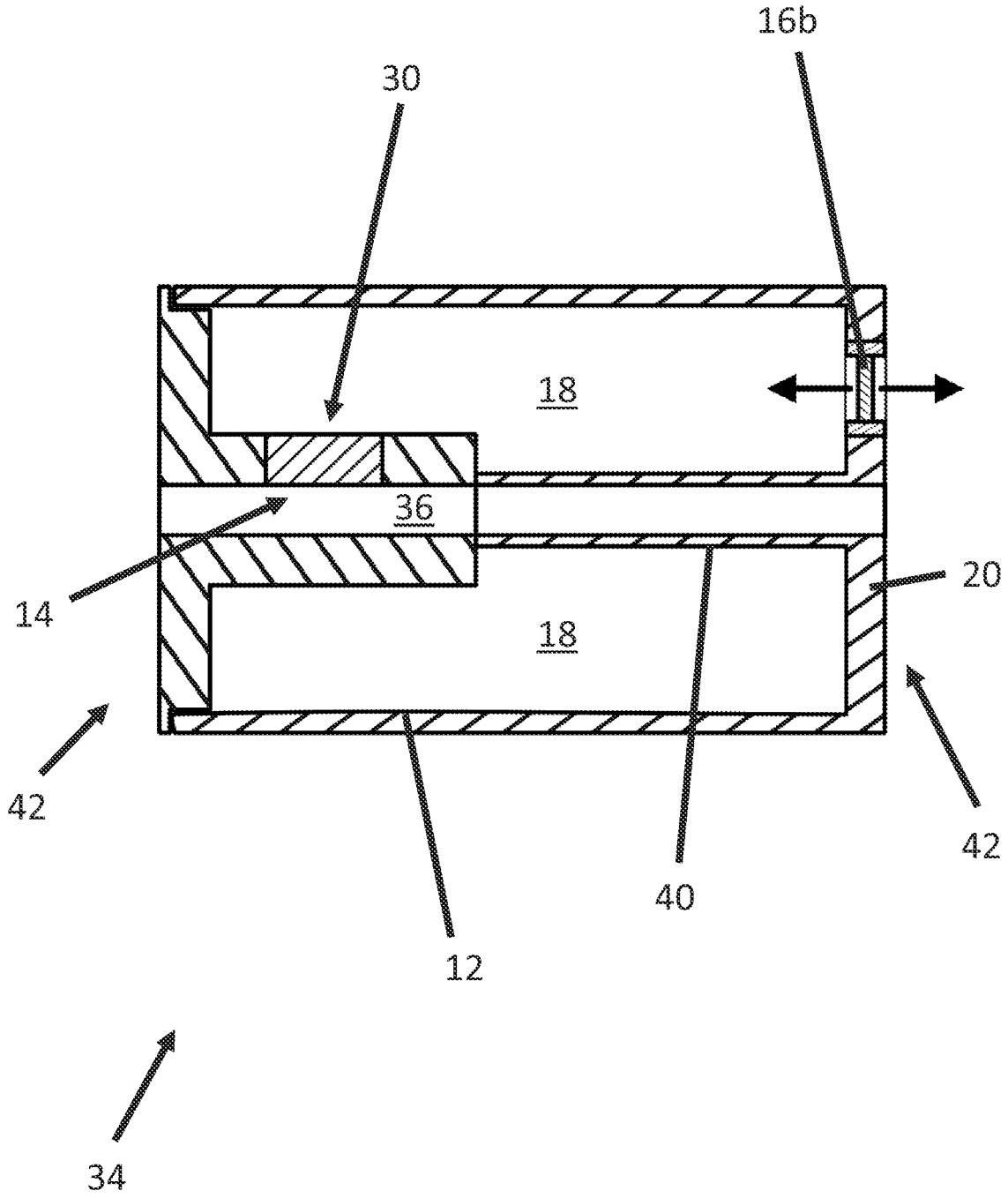
FIG. 9 shows the schematic representation of a cross-section through a vaporizer unit according to the invention in a second preferred embodiment.
Figure 10:
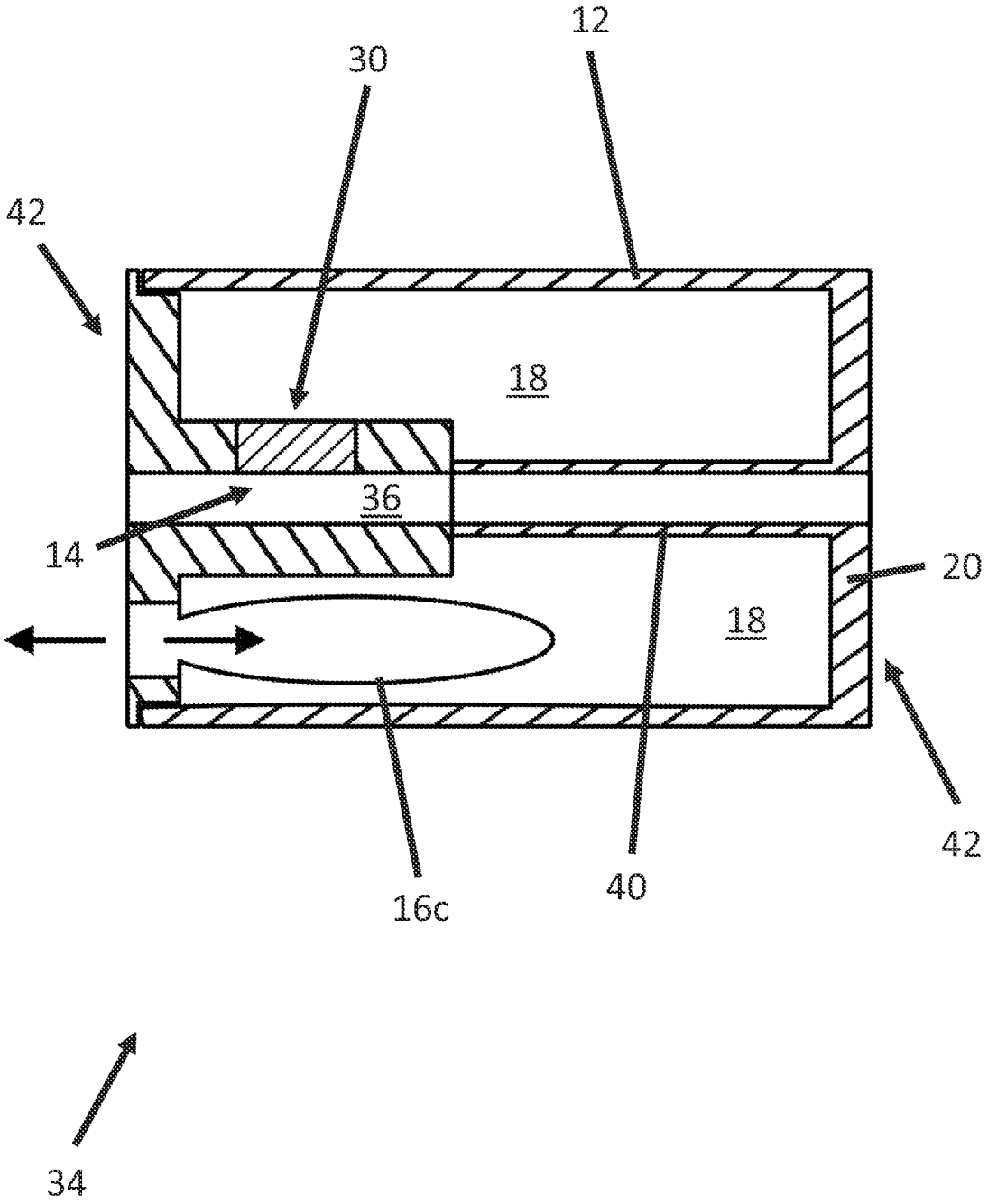
FIG. 10 shows the schematic representation of a cross-section through a vaporizer unit according to the invention in a third preferred embodiment.

Vaporizer units 34 according to the invention and disclosed in FIGS. 8 to 10 have in each case an element for pressure regulation 16, wherein this involves a non-return valve 16*a*, namely a lip valve, a gas-permeable but liquid-impermeable diaphragm 16*b*, namely a hydrophobic diaphragm composed of polytetrafluoroethylene or a deformable wall portion 16*c*, namely a deformable bag composed of rubber-elastic plastic which comprises an elastomer which was produced from silicon rubber and which projects into reservoir 12.

Figure 11:
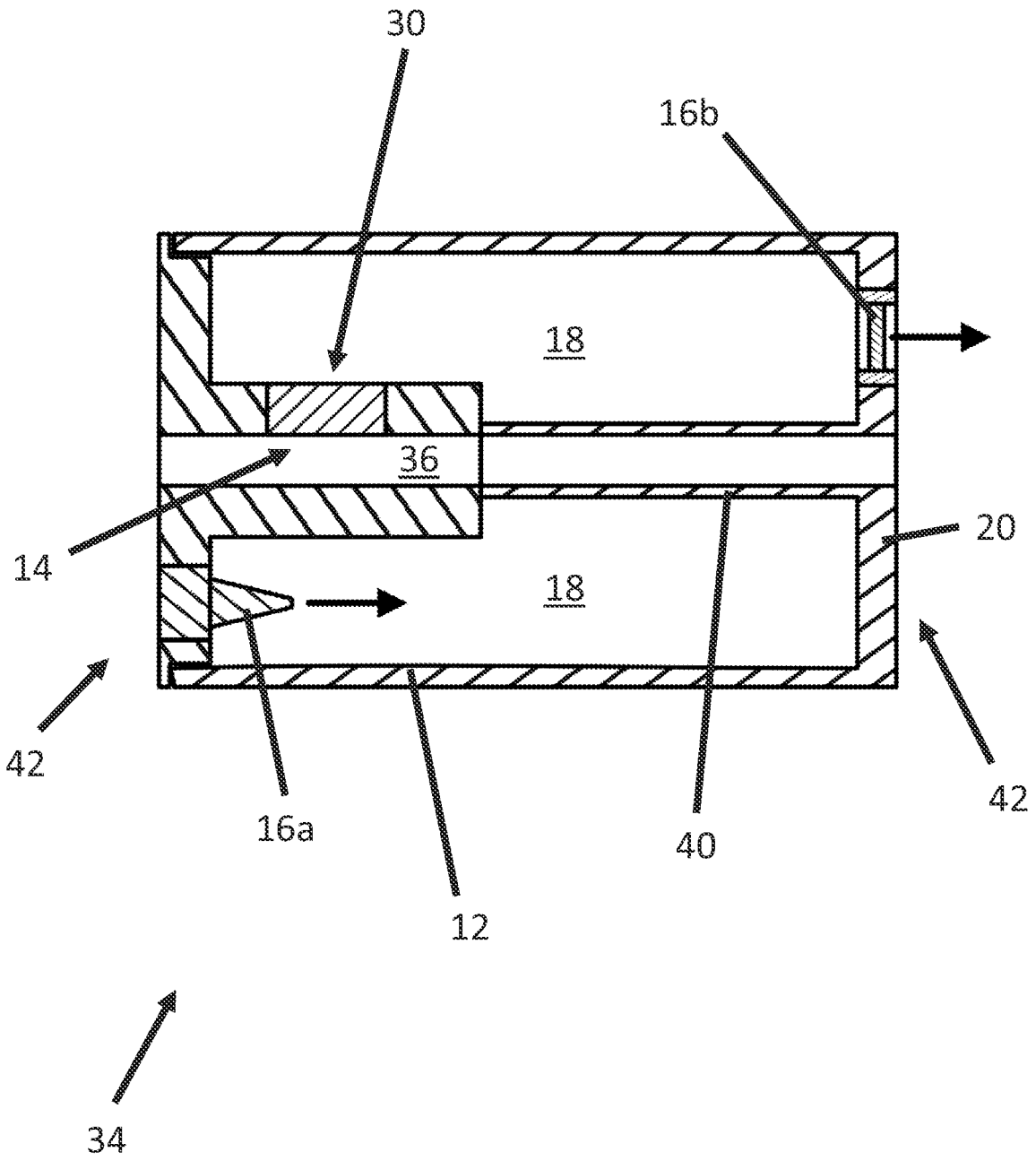
FIG. 11 shows the schematic representation of a cross-section through a vaporizer unit according to the invention in a fourth preferred embodiment.
Figure 12:
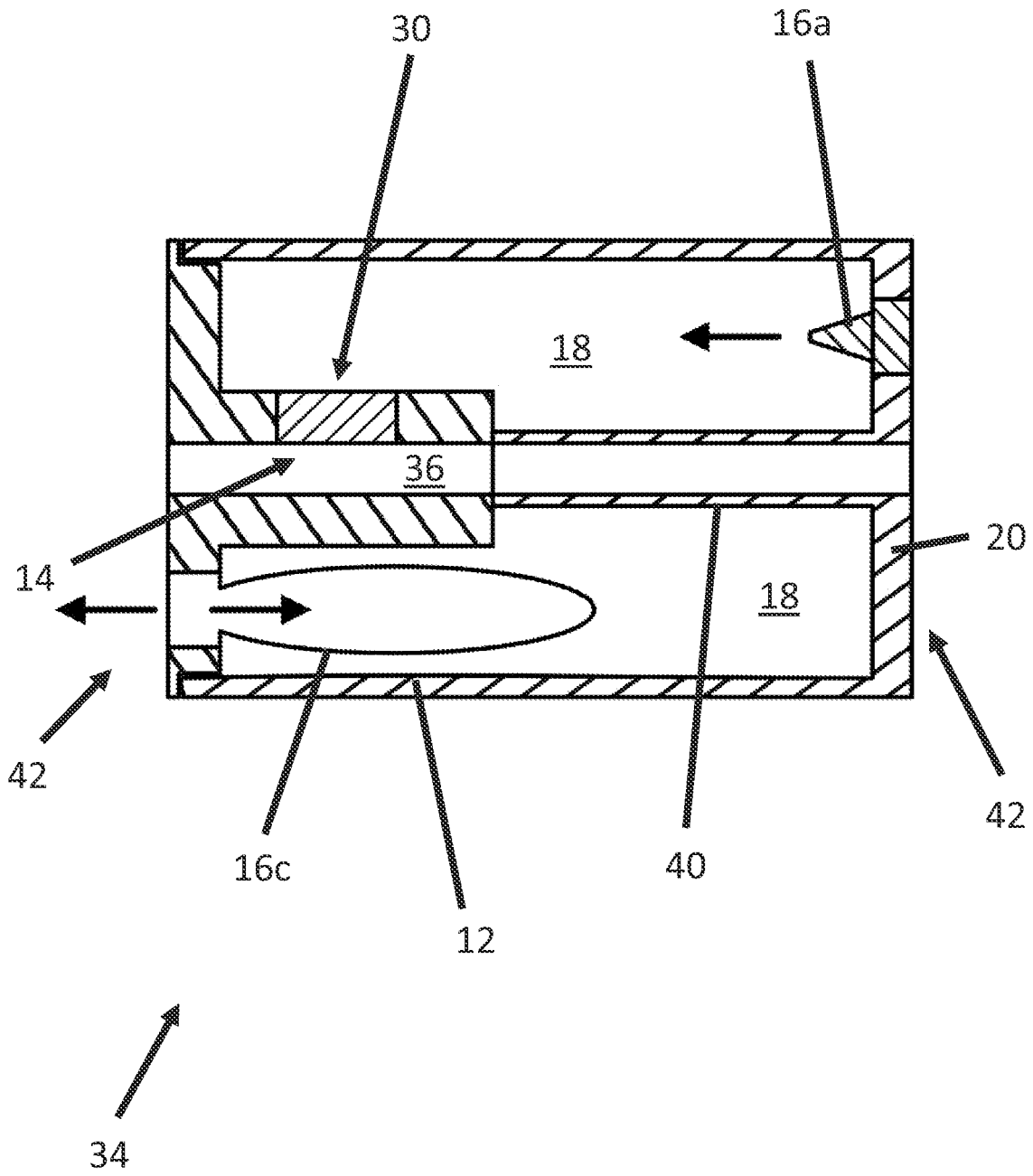
FIG. 12 shows the schematic representation of a cross-section through a vaporizer unit according to the invention in a fifth preferred embodiment.

In contrast to this, vaporizer units 34 which are represented in FIGS. 11 and 12 comprise in each case two of the above-mentioned elements for pressure regulation 16 which are arranged on different sides of reservoir 12, wherein FIG. 11 discloses the combination of a non-return valve 16*a* with a gas-permeable but liquid-impermeable diaphragm 16*b*, while FIG. 12 shows the combination of a non-return valve 16*a* with a deformable wall portion 16*c*.

Cartridges 10 according to the invention and shown in FIGS. 2 to 6 can be used together with a heating unit 30 as well as in vaporizer systems according to the invention like vaporizer units 34 according to the invention and disclosed in FIGS. 8 to 12. For this purpose, these must be combined with at least one electric energy source for operation of the electric heating element. Vaporizer units 34 disclosed in FIGS. 8 to 12 are designed as single-use parts which can be connected to a reusable part comprising the electric energy source detachably in a reversible and destruction-free manner so that there is not only a fluid-conducting contact between reservoir 12 and the electric heating element in heating unit 30, but also an electric contact between the electric energy source and the electric heating element.

In contrast to this, cartridges 10 according to the invention and disclosed in FIGS. 2 to 6 are provided in the represented form for use with a reusable heater which can be arranged, for example, jointly with the electric energy source in the reusable part, or in a third part as a further component. For this purpose, cartridges 10 according to the invention are filled in their interior 18 with a composition to be vaporized, wherein the composition comprises, for example, nicotine, 1,2-propanediol, glycerine and water. After filling, extraction opening 14 is closed off, for example, with a plastic film. Prior to use, the plastic film over extraction opening 14 is removed or irreversibly destroyed and cartridge 10 according to the invention is connected to the reusable part detachably in a reversible and destruction-free manner so that extraction opening 14 is arranged in contact with heating unit 30. In the embodiments of a vaporizer unit 34 according to the invention shown in FIGS. 8 to 12, the elements for pressure regulation 16 are arranged in each case in cartridge 10 so that these, when installed in a vaporizer system, are not arranged on or in the outer sleeve of the vaporizer system. This is due to the fact that base areas 42 are provided for connection of vaporizer unit 34 according to the invention to the reusable part, or in practice are covered with a mouthpiece which shields the elements for pressure regulation.

REFERENCE NUMBERS

10 Cartridge
12 Reservoir
14 Extraction opening
16 Element for pressure regulation
16*a* Non-return valve
16*b* Diaphragm
16*c* Deformable wall portion
18 Interior of the reservoir
20 Wall of the reservoir
30 Heating unit
34 Vaporizer unit
36 Air channel
40 Vent
42 Base areas

The invention claimed is:

1. A cartridge for an electronic cigarette or a portable inhaler, comprising:

a rigid reservoir for receiving a liquid, the reservoir having at least one extraction opening configured to enable the extraction of liquid from the reservoir;

the reservoir comprising two or more pressure regulation elements in an interior of the reservoir, the pressure regulation elements being arranged in one or more walls of the reservoir and no exit of liquid from the reservoir through the pressure regulation elements is possible;

the two or more pressure regulation elements including a deformable wall portion and at least one of a non-return valve or a gas-permeable but liquid-impermeable diaphragm;

wherein the deformable wall portion is reversibly deformable and formed of a rubber-elastic plastic which comprises one or more elastomers which were produced from rubbers which are selected from the group comprising natural rubber and synthetic rubber; and wherein the deformable wall portion is formed as a deformable bag which projects into the reservoir or projects out of the reservoir, and wherein the volume of the deformable bag is smaller without a presence of a pressure difference than a volume of the reservoir.

2. The cartridge according to claim 1, wherein:

the reservoir is composed of one or more materials which are selected from the group comprising glass, crystal, metal, ceramic, wood and plastic;

and/or the reservoir is embodied in one piece or in two pieces;

and/or the reservoir is configured so that, in the case of an internal pressure in the reservoir of 120 kPa or more, and an external pressure of 100 kPa, liquid can exit from the reservoir exclusively through the extraction opening.

3. The cartridge according to claim 2, wherein the reservoir is two pieces and is composed of glass and plastic.

4. The cartridge according to claim 1, wherein the two or more pressure regulation elements comprises the non-return valve in the form of a lip valve, the non-return valve formed so that it opens in a case of a vacuum pressure in the reservoir in comparison with an external pressure of 1 kPa or more, wherein the non-return valve is composed of a flexible material which comprises one or more elastomers which have been produced from rubbers which are selected from the group comprising natural rubber and synthetic rubber.

5. The cartridge according to claim 1, wherein the two or more pressure regulation elements comprises the gas-permeable but liquid-impermeable diaphragm in the form of a hydrophobic plastic diaphragm comprising polytetrafluorethylene, wherein the diaphragm is formed so that it enables a passage of gaseous water and/or gaseous 1,2-propanediol and/or gaseous glycerine.

6. The cartridge according to claim 1, wherein:

the two or more pressure regulation elements are arranged on different sides of the reservoir.

7. The cartridge according to claim 6, wherein:

the two or more pressure regulation elements comprises the gas-permeable but liquid-impermeable diaphragm and the deformable wall portion.

8. The cartridge according to claim 1, wherein:

the two or more pressure regulation elements are arranged in a wall of the reservoir which has on average a largest distance to the extraction opening;

and/or a distance between the extraction opening and the two or more pressure regulation elements is larger than an average diameter of the extraction opening.

9. A vaporizer unit, comprising:

a cartridge according to claim 1;

a heating unit with a wick material and with an electric heating element arranged so that the wick material is arranged in the extraction opening and/or the extraction opening is covered and such that liquid travels from the reservoir via the wick material to the electric heating element.

10. The vaporizer unit according to claim 9, wherein the electric heating element is a wire coil or a heater film or a plate-shaped heater chip.

11. The vaporizer unit according to claim 9, wherein the electric heating element is a plate-shaped heater chip composed of a doped or undoped semiconductor material which is crossed by a multiplicity of microchannels which provide a liquid-conducting connection between a side of the heater chip facing the wick material and a side of the heater chip facing an air channel.

12. The vaporizer unit according to claim 9, wherein the heating unit comprises sealing elements to enclose the electric heating element and is connected at the extraction opening in a fluid-impervious manner to the reservoir in such a manner that liquid and gas can exit from the interior of the reservoir through the extraction opening exclusively through the heating unit.

13. The vaporizer unit according to claim 9, wherein the electric heating element and/or the wick material are configured so that they do not enable any passage of liquid through the extraction opening and through the heating element up to a pressure difference between an internal pressure in the reservoir and an external pressure of 1 kPa.

14. The vaporizer unit according to claim 9, wherein the reservoir is cylindrical or rectangular and the extraction opening is arranged on a vent which extends from one of base areas of the cylinder or rectangle into an interior of the cylinder or rectangle.

15. A vaporizer system for vaporizing a composition in a portable handheld evaporation apparatus, comprising:

a cartridge according to claim 1;

and a heating unit or an evaporator vaporizer unit with a heating unit with a wick material and with an electric heating element arranged so that the wick material is arranged in the extraction opening and/or the extraction opening is covered and such that liquid travels from the reservoir via the wick material to the electric heating element;

and at least one electric energy source for operation of the electric heating element.

16. The vaporizer system according to claim 15, wherein the vaporizer system comprises an E-cigarette or an inhaler for medical purposes.

17. The vaporizer system according to claim 15, wherein the cartridge is arranged in a first part, being a single-use part, and the electric energy source is arranged in a second part, being a reusable part, wherein the first part and the second part are connected to one another detachably in a reversible and destruction-free manner so that there is electric contact between the electric energy source and the electric element as well as a fluid-conducting contact between the reservoir and the electric heating element.

18. The vaporizer system according to claim 17, further comprising a third part, wherein the heating unit is arranged in the first part or in the second part or in the third part, wherein the first part, the second part and the third part are connected to one another detachably in a reversible and destruction-free manner so that there is electric contact between the electric energy source and the electric heating element as well as fluid-conducting contact between the reservoir and the electric heating element.

19. The vaporizer system according to claim 15, wherein one or more pressure regulation elements for are arranged in the cartridge so that they are not arranged on or in an outer sleeve of the vaporizer system.

* * * * *